US007573454B2

(12) United States Patent
Morita

(10) Patent No.: US 7,573,454 B2
(45) Date of Patent: Aug. 11, 2009

(54) DISPLAY DRIVER AND ELECTRO-OPTICAL DEVICE

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 753 days.

(21) Appl. No.: 10/913,526

(22) Filed: Aug. 9, 2004

(65) Prior Publication Data

US 2005/0068286 A1 Mar. 31, 2005

(30) Foreign Application Priority Data

Sep. 10, 2003 (JP) ..... 2003-318081

(51) Int. Cl.
*G09G 3/36* (2006.01)

(52) U.S. Cl. ..... 345/100; 345/87

(58) Field of Classification Search ..... 345/87–100, 345/204–213, 690–699
See application file for complete search history.

(56) References Cited

U.S. PATENT DOCUMENTS

| | | | | |
|---|---|---|---|---|
| 6,124,840 | A * | 9/2000 | Kwon | 345/100 |
| 6,559,824 | B1 * | 5/2003 | Kubota et al. | 345/100 |
| 6,628,259 | B2 * | 9/2003 | Hashimoto | 345/98 |
| 7,123,247 | B2 | 10/2006 | Morita | |
| 7,212,220 | B2 * | 5/2007 | Chang et al. | 345/698 |
| 2002/0190973 | A1 | 12/2002 | Morita | |

FOREIGN PATENT DOCUMENTS

| | | | |
|---|---|---|---|
| CN | 1389846 A | | 1/2003 |
| JP | 06202578 A | * | 7/1994 |
| JP | A-06-202578 | | 7/1994 |
| JP | A-08-314417 | | 11/1996 |
| JP | A-2001-154644 | | 6/2001 |
| JP | A 2002-351412 | | 12/2002 |

OTHER PUBLICATIONS

U.S. Appl. No. 10/912,247, filed Aug. 6, 2004, Morita.
U.S. Appl. No. 10/913,464, filed Aug. 9, 2004, Morita.
U.S. Appl. No. 10/928,174, filed Aug. 30, 2004, Morita.

* cited by examiner

*Primary Examiner*—Chanh Nguyen
*Assistant Examiner*—Allison Walthall
(74) *Attorney, Agent, or Firm*—Oliff & Berridge, PLC

(57) ABSTRACT

A display driver which drives a plurality of data lines of an electro-optical panel, including: a data input section to which display data or setting data is input; a display processing section having a data line driver section which drives the data lines based on the display data input through the data input section; a control register which is used for controlling the display processing section; and a fetch section which fetches the setting data input through the data input section based on an initial setting signal. The setting data fetched into the fetch section is set in the control register after at least one of the display processing section and the control register has been initialized by an initialization signal. The display processing section is controlled based on the setting data set in the control register.

13 Claims, 16 Drawing Sheets

FIG. 14

| NOUT | NUMBER OF OUTPUTS |
|---|---|
| H | $\alpha$ (S1 TO S$\alpha$ : OUTPUT STATE) |
| L | $\beta$ $(1 < \beta < \alpha)$ { S1 TO S$\beta$ : OUTPUT STATE<br>S ($\beta$ + 1) TO S$\alpha$ : NON-OUTPUT STATE |

DISPLAY DRIVER AND ELECTRO-OPTICAL DEVICE

Japanese Patent Application No. 2003-318081, filed on Sep. 10, 2003, is hereby incorporated by reference in its entirety.

BACKGROUND OF THE INVENTION

The present invention relates to a display driver and an electro-optical device.

An electro-optical device represented by a liquid crystal display device includes a plurality of scanning lines, a plurality of data lines, and a plurality of pixels. The scanning lines are sequentially selected by a scanning driver within one vertical scanning period. The data lines are driven by a data driver in units of one horizontal scanning period.

Display data is serially supplied to the data driver from a display controller in pixel units, for example. The data driver shifts the serially input display data and generates display data for one horizontal scan. The data driver drives the data lines based on the display data for one horizontal scan. For example, the data driver can change the shift direction of the display data supplied from the display controller depending on the mounting state. This reduces the interconnect length between the display controller and the data driver. Therefore, the data driver includes a terminal for setting the shift direction of the display data, and the shift direction of the display data can be changed corresponding to the state of the terminal at the time of initialization. The data driver includes various other terminals, and controls corresponding to the state of the terminals at the time of initialization.

BRIEF SUMMARY OF THE INVENTION

According to one aspect of the present invention, there is provided a display driver which drives a plurality of data lines of an electro-optical panel which has a plurality of scanning lines and a plurality of pixels in addition to the data lines, the display driver comprising:

a data input section to which display data or setting data is input;

a display processing section having a data line driver section which drives the data lines based on the display data input through the data input section;

a control register which is used for controlling the display processing section; and a fetch section which fetches the setting data based on an initial setting signal, the setting data having been input through the data input section, wherein the setting data fetched into the fetch section is set in the control register after at least one of the display processing section and the control register has been initialized by an initialization signal; and wherein the display processing section is controlled based on the setting data set in the control register.

According to another aspect of the present invention, there is provided an electro-optical device comprising:

a plurality of scanning lines;

a plurality of data lines;

a plurality of pixels; and the above-described display driver which drives the data lines.

BRIEF DESCRIPTION OF THE SEVERAL VIEWS OF THE DRAWING

FIG. 14 shows an example of the number of outputs set by a number-of-outputs setting signal.

DETAILED DESCRIPTION OF THE EMBODIMENTS

Figure 1:
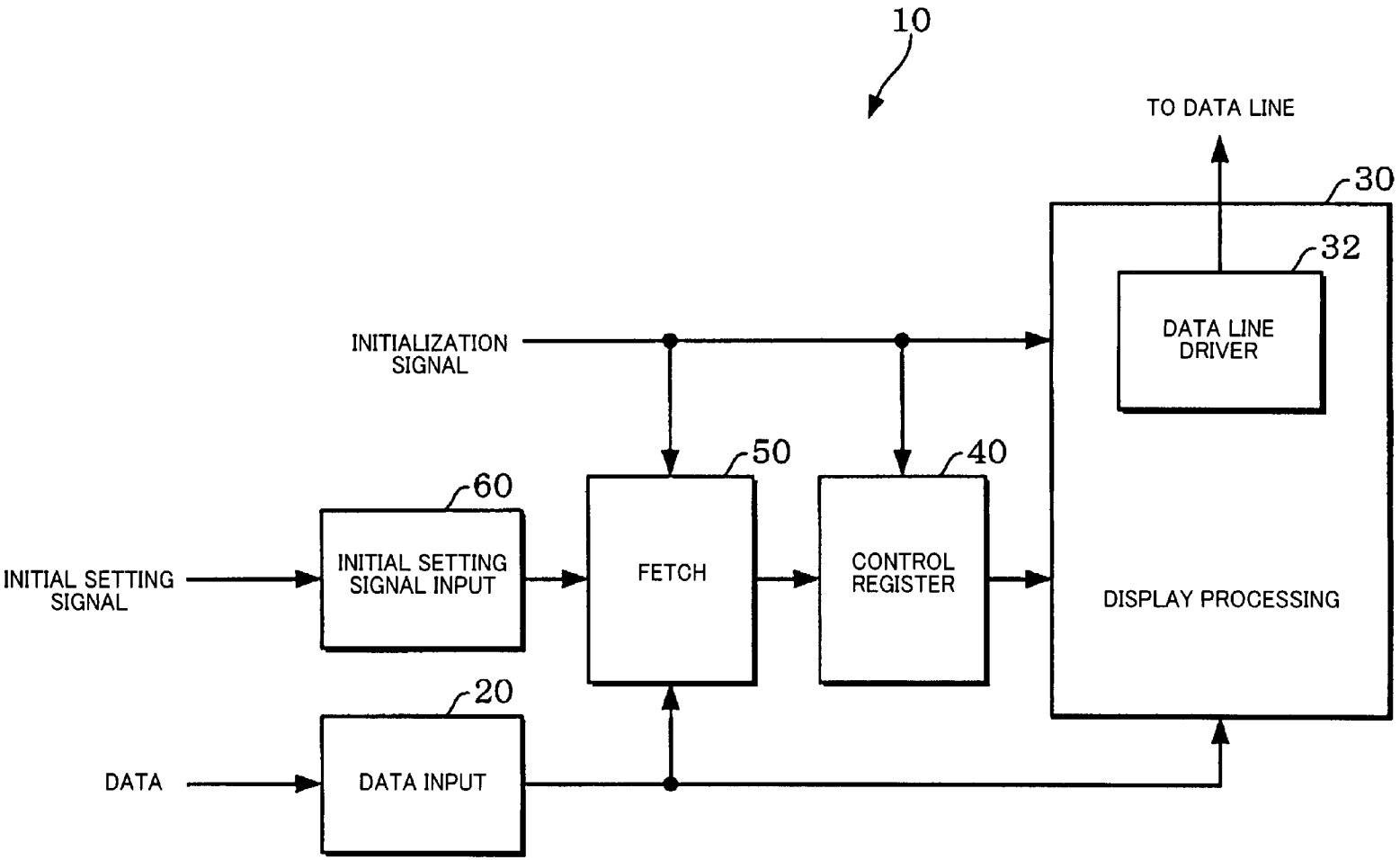
FIG. 1 is a diagram schematically showing a display driver according to one embodiment of the present invention.

Embodiments of the present invention will be described below. Note that the embodiments do not in any way limit the scope of the invention laid out in the claims herein. In addition, not all of the elements of the embodiments described below should be taken as essential requirements of the present invention.

As the number of functions of the data driver is increased, the number of terminals set at the time of initialization is increased. The number of data lines of an electro-optical device is also significantly increased accompanying an increase in the display size. Therefore, since the number of terminals of the data driver for driving the data lines is significantly increased, it is difficult to further increase the number of other terminals.

This is because the chip size is increased as the number of terminals of the data driver is increased, thereby resulting in an increase in cost. Moreover, since an input buffer or an input/output buffer connected to the terminal consumes a large amount of power, an increase in the number of terminals increases power consumption. Therefore, it is desirable that the number of terminals of the data driver be as small as possible. It is particularly desirable that the number of terminals referred to only at the time of initialization be small.

The following embodiments of the present invention may provide a display driver and an electro-optical device which enable the number of terminals referred to only at the time of initialization to be reduced.

According to one embodiment of the present invention, there is provided a display driver which drives a plurality of data lines of an electro-optical panel which has a plurality of scanning lines and a plurality of pixels in addition to the data lines, the display driver comprising:

a data input section to which display data or setting data is input;

a display processing section having a data line driver section which drives the data lines based on the display data input through the data input section;

a control register which is used for controlling the display processing section; and a fetch section which fetches the setting data based on an initial setting signal, the setting data having been input through the data input section, wherein the setting data fetched into the fetch section is set in the control register after at least one of the display processing section and the control register has been initialized by an initialization signal; and wherein the display processing section is controlled based on the setting data set in the control register.

In this display driver, the display data or the setting data is input to the data input section. The data line driver section included in the display processing section is controlled based on the setting data set in the control register, and the data line driver section drives the data line of the electro-optical panel based on the display data input through the data input section. The fetch section fetches the setting data input through the data input section, based on the initial setting signal. The setting data fetched into the fetch section is set in the control register after at least one of the display processing section and the control register has been initialized by the initialization signal.

This enables the display processing section to be controlled by using the setting data input to the data input section during the initialization processing by the initialization signal. Since the data input section can be used in common as the input section for the setting data for initial setting and the input section for the display data, the number of terminals for initial setting can be reduced in the display driver.

In this display driver, the initial setting signal may be the initialization signal.

Since this enables the display processing section to be finely controlled by setting of the setting data using the initialization signal, the configuration of the display driver can be simplified without generating a new initial setting signal, whereby the cost can be reduced.

This display driver may further comprise:

a first delay circuit which delays the initialization signal for a first delay time;

a second delay circuit which delays the initialization signal for a second delay time which is longer than the first delay time;

a selector which selectively outputs an output from the first delay circuit or a clock signal, based on an output from the second delay circuit; and a latch circuit which fetches the display data or the setting data based on an output from the selector, each of the display data and the setting data having been input through the data input section, wherein the display data may be input to the data input section in synchronization with the clock signal;

wherein the data line driver section may drive the data lines by using the display data fetched into the latch circuit based on the clock signal selectively output by the selector;

wherein the fetch section may include a buffer which holds the setting data based on the outputs from the first and second delay circuits, the setting data having been fetched into the latch circuit based on the output from the first delay circuit selectively output by the selector; and wherein the setting data held by the buffer may be set in the control register based on a horizontal synchronization signal which specifies a horizontal scanning period or based on a vertical synchronization signal which specifies a vertical scanning period.

In this display driver, the setting data cannot be set in a state in which each section of the display driver is initialized by the initialization signal as the initial setting signal. Therefore, the first and second delay circuits which delay the initialization signal are provided, and the latch circuit fetches the setting data from the data input section based on the output from the first delay circuit with a shorter delay time. The latch circuit fetches the display data from the data input section based on the clock signal switched based on the output from the second delay circuit with a longer delay time. The setting data fetched into the latch circuit is held by the buffer, and set in the control register based on the horizontal synchronization signal or the vertical synchronization signal.

This enables the setting data input to the data input section during the initialization processing to be set in the control register by using the initialization signal with a simple configuration, whereby the cost of the display driver can be further reduced.

In this display driver, the setting data may be set in the control register during a horizontal blanking interval specified by the horizontal synchronization signal or during a vertical blanking interval specified by the vertical synchronization signal.

If the display processing section is set by utilizing the blanking period which does not affect the display, deterioration of the display quality can be reduced. Moreover, if the setting data held by the buffer is repeatedly set in the control register, erroneous operation caused by change of the value in the control register due to noise by static electricity or the like can be prevented.

In this display driver, when the setting data fetched into the fetch section is first data, at least an output of the data line driver section to the data lines may be suspended.

In this display driver, when the setting data fetched into the fetch section is second data, setting of the setting data in the control register may be omitted.

This enables to prevent erroneous setting of the setting data in the control register even if the display driver is connected to a display controller which cannot set the setting data at the time of initialization.

The display driver may further comprise an initial setting signal input section to which the initial setting signal is input.

Using the initialization signal as the initial setting signal means that the display driver includes an initialization signal input section.

According to one embodiment of the present invention, there is provided an electro-optical device comprising:

a plurality of scanning lines;

a plurality of data lines;

a plurality of pixels; and the above-described display driver which drives the data lines.

An electro-optical device which is simplified in configuration and size can be provided by reducing the number of terminals of the display driver.

These embodiments of the present invention are described below in detail with reference to the drawings.

FIG. 1 schematically shows a display driver according to one embodiment of the present invention. A display driver 10 in this embodiment includes a data input section 20, a display processing section 30, a control register 40, and a fetch section 50.

Display data or setting data (data in a broad sense) is input to the data input section 20. The display data or setting data is supplied from a display controller (not shown). The function of the data input section 20 is realized by one or more data input terminals (terminals in a broad sense), for example. Or, the function of the data input section 20 is realized by one or more data input terminals and one or more input buffers (or input/output buffers) electrically connected with the data input terminals.

The display processing section 30 performs display processing of driving a plurality of data lines of an electro-optical panel based on the display data input through the data input section 20. The display processing section 30 shifts the display data serially input through the data input section 20 in pixel units, and generates data for one horizontal scan. The display processing section 30 includes a data line driver section 32, and drives the data lines based on the data for one horizontal scan.

The display processing section 30 including the data line driver section 32 is controlled based on the setting data (control information corresponding to setting data) set in the control register 40. The setting data input through the data input section 20 is set in the control register 40 (as control information).

The fetch section 50 fetches the setting data (data in a broad sense) input through the data input section 20 based on an initial setting signal. As the initial setting signal, an initialization signal which initializes at least one of the display processing section 30 and the control register 40 may be used. The initial setting signal or the initialization signal is supplied from the display controller (not shown).

For example, the display driver 10 may include an initial setting signal input section 60 to which the initial setting signal is input. The function of the initial setting signal input section 60 is realized by one or more initial setting signal input terminals (terminals in a broad sense), for example. Or, the function of the initial setting signal input section 60 is realized by one or more initial setting signal input terminals and one or more input buffers (or input/output buffers) electrically connected with the initial setting signal input terminals. In the case where the initialization signal is used as the initial setting signal, the display driver 10 may include an initialization signal input section to which the initialization signal is input. The function of the initialization signal input section is realized by one or more initialization setting signal input terminals (terminals in a broad sense), for example. Or, the function of the initialization signal input section is realized by one or more initialization signal input terminals and one or more input buffers (or input/output buffers) electrically connected with the initialization signal input terminals.

In the display driver 10, the setting data fetched into the fetch section 50 is set in the control register 40 after at least one of the display processing section 30 and the control register 40 is initialized by the initialization signal. The display processing section 30 is controlled based on the setting data set in the control register 40.

This enables the data input section to be used in common as the input section for inputting the display data and the input section for inputting the setting data for setting the display processing section 30 at the time of initialization. Therefore, a terminal for setting the display processing section 30 or the like at the time of initialization in order to control the display processing section 30 or the like is made unnecessary in the display driver 10, whereby a reduction of cost and power consumption of the display driver 10 can be achieved.

In the following description, the initialization signal is used as the initial setting signal.

The fetch section 50 and a configuration example for controlling the fetch section 50 are described below.

Figure 2:
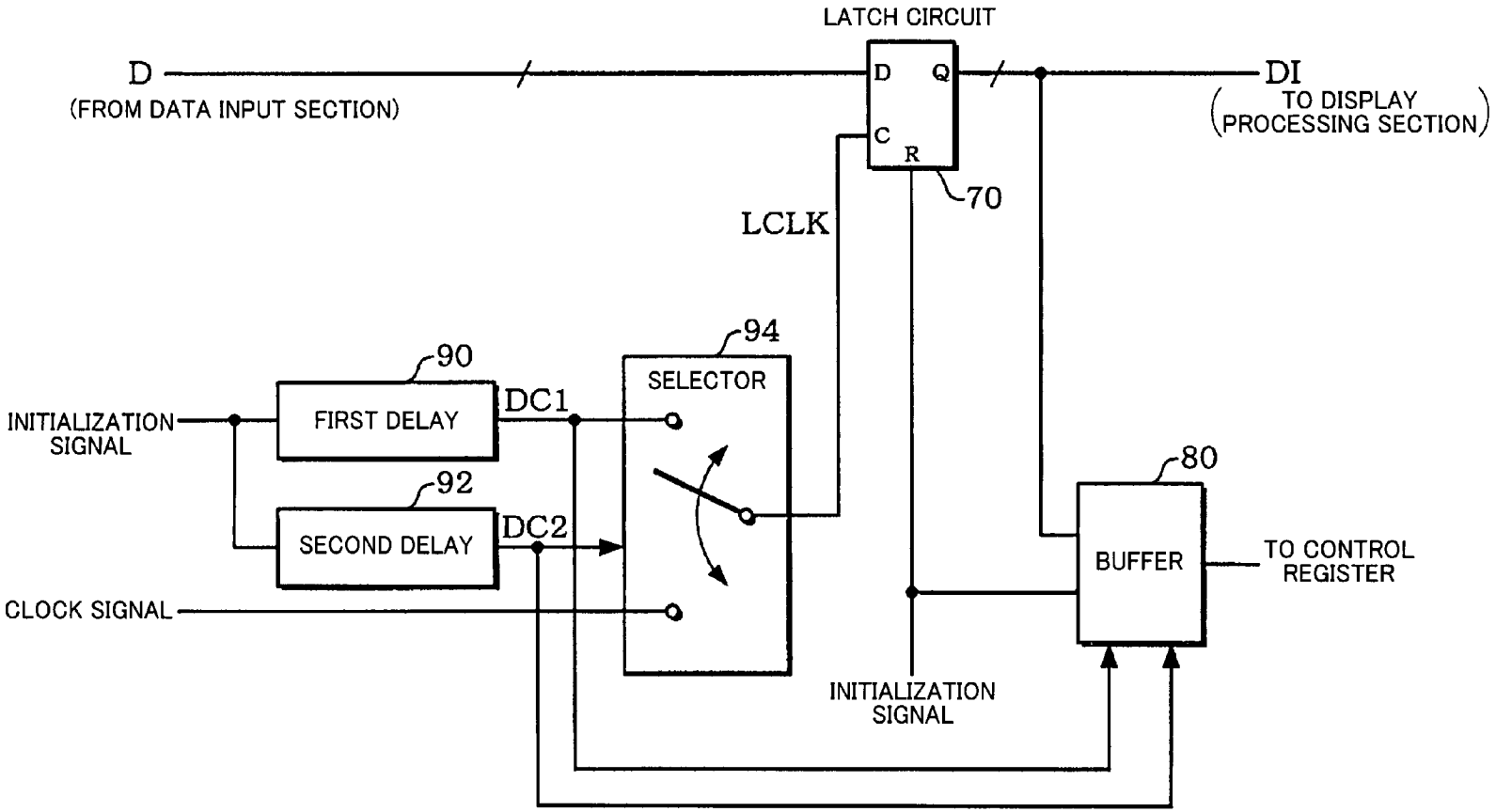
FIG. 2 is a block diagram showing the fetch section shown in FIG. 1 and a configuration example for controlling the fetch section.

FIG. 2 shows the fetch section 50 and a configuration example for controlling the fetch section 50.

A latch circuit 70 fetches the display data or the setting data input through the data input section 20. The display data fetched into the latch circuit 70 is supplied to the display processing section 30. The setting data fetched into the latch circuit 70 is held by a buffer 80 included in the fetch section 50.

The display driver 10 includes first and second delay circuits 90 and 92, and a selector 94. The first delay circuit 90 generates a delay signal DC1 by delaying the initialization signal for a first delay time d1. The second delay circuit 92 generates a delay signal DC2 by delaying the initialization signal for a second delay time d2 longer than the first delay time d1 (d1<d2). The selector 94 selectively outputs the output from the first delay circuit 90 (delay signal DC1) or a clock signal as a select output signal LCLK based on the output from the second delay circuit 92 (delay signal DC2). The display data is input to the data input section 20 in synchronization with the clock signal.

The latch circuit 70 can fetch the display data or the setting data input through the data input section 20 by using the output from the selector 94 (select output signal LCLK) as a latch clock signal. The data line driver section 32 drives the data lines using the display data fetched into the latch circuit 70 based on the clock signal selectively output by the selector 94. The buffer 80 in the fetch section 50 holds the setting data fetched into the latch circuit 70 based on the output from the first delay circuit 90 (delay signal DC1) selectively output by the selector 94 based on the outputs from the first and second delay circuits 90 and 92.

The setting data held by the buffer 80 is set in the control register 40 (as control information (control signal)). The setting data is set in the control register 40 based on a horizontal synchronization signal which specifies a horizontal synchronization period or a vertical synchronization signal which specifies a vertical scanning period.

Figure 3:
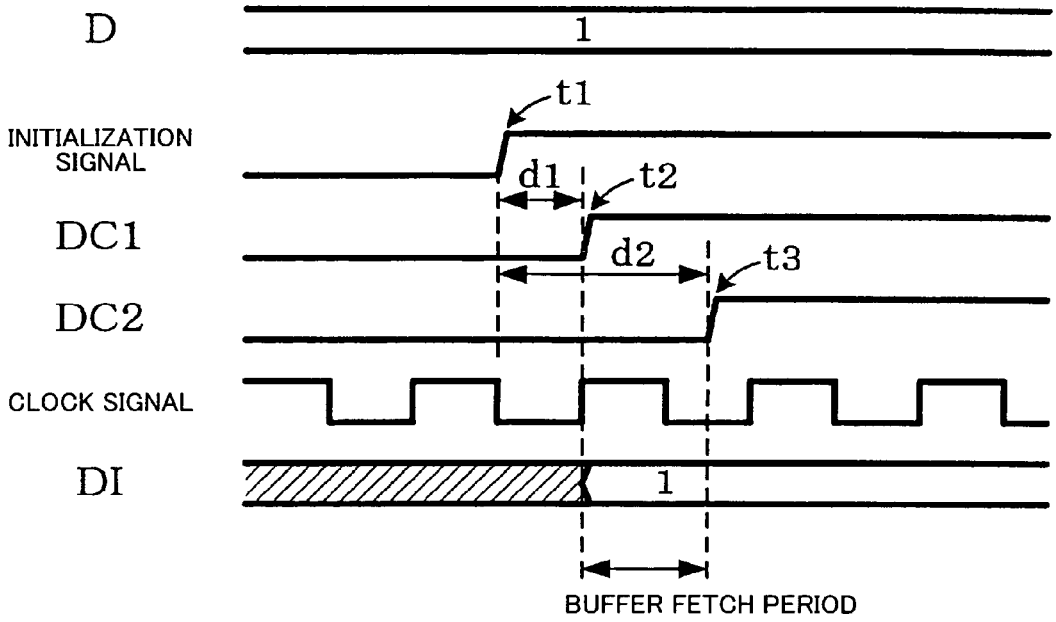
FIG. 3 is a timing chart showing an operation example of the circuit shown in FIG. 2.

FIG. 3 is a timing chart showing an operation example of the configuration shown in FIG. 2.

When the initialization signal is set at the L level, the internal circuit of the display driver is initialized. Therefore, the latch circuit 70 and the buffer 80 shown in FIG. 2 remain in the initial state.

After a time t1 at which the initialization signal changes from the L level to the H level, the contents held by the latch circuit 70 and the buffer 80 can be changed. Therefore, the first and second delay circuits 90 and 92 generate the delay signals DC1 and DC2 by delaying the initialization signal. In order to fetch the setting data input through the data input section 20 after the time t1, the selector 94 selectively outputs the delay signal DC1 generated by delaying the initialization signal for the first delay time d1 as the select output signal LCLK. This enables the latch circuit 70 to fetch the setting data input through the data input section 20 at the rising edge (time t2) of the delay signal DC1.

The selector 94 selectively outputs the clock signal as the select output signal LCLK by the delay signal DC2 which is delayed for the second delay time d2 in order for the latch circuit 70 to fetch the display data. This enables the latch circuit 70 to fetch the display data input through the data input section 20 using the selected clock signal after a time t3 at which the delay signal DC2 rises.

In order to hold the setting data fetched into the latch circuit 70 in the buffer 80, it is preferable that the period between the time t2 and the time t3 be a buffer fetch period. In FIG. 2, a signal which specifies the buffer fetch period is generated using the delay signals DC1 and DC2, and the buffer 80 holds the setting data fetched into the latch circuit 70 based on the generated signal.

FIG. 2 illustrates the case where the fetch section 50 includes the buffer 80. However, at least one of the latch circuit 70, the first and second delay circuits 90 and 92, and the selector 94 shown in FIG. 2 may be included in the fetch section 50.

Figure 4:
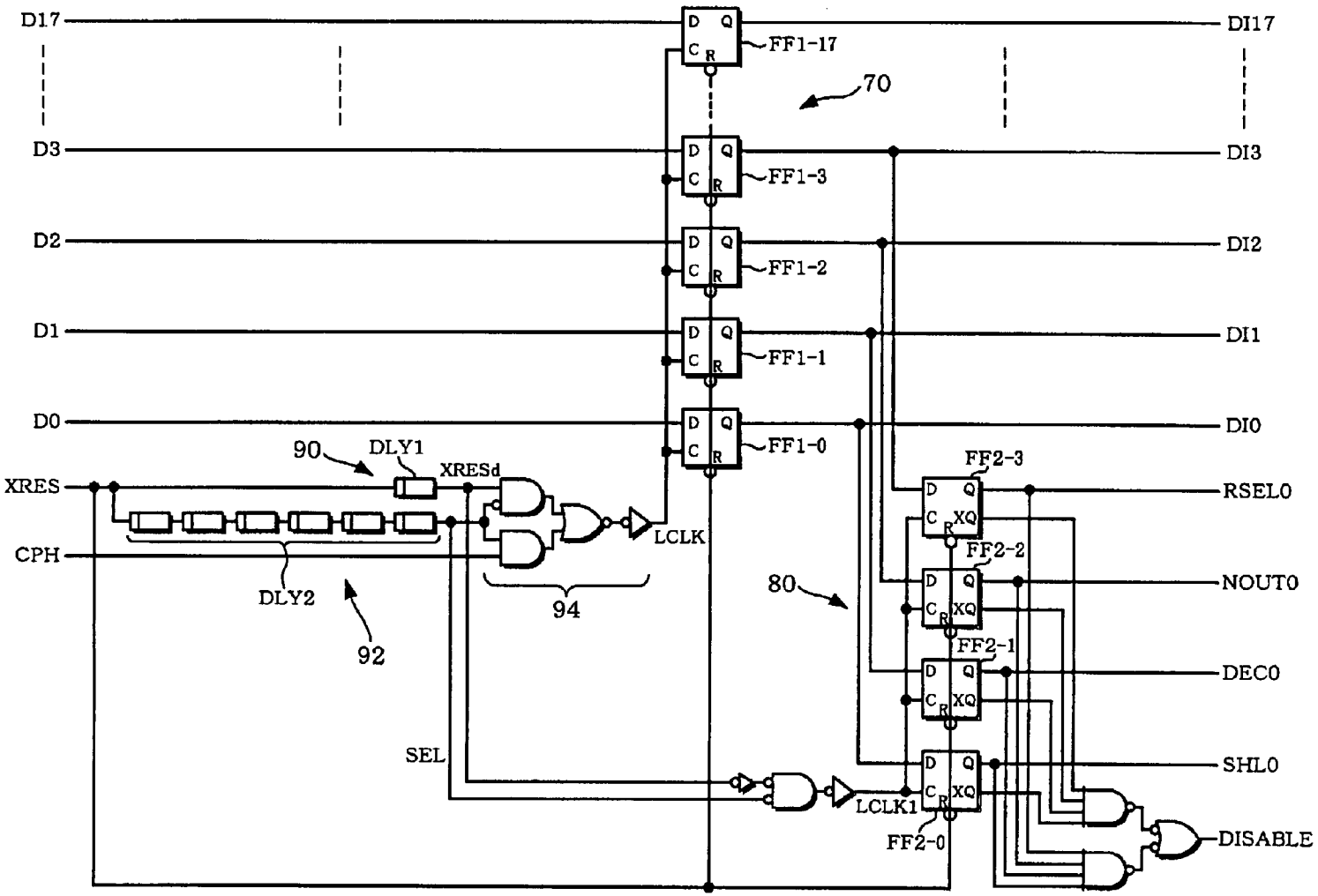
FIG. 4 is a circuit diagram showing the fetch section shown in FIG. 2 and a configuration example for controlling the fetch section.

FIG. 4 shows the fetch section 50 shown in FIG. 2 and a circuit configuration example for controlling the fetch section 50. Note that components corresponding to those in FIG. 2 are denoted by the same reference numbers and further description thereof is omitted.

In FIG. 4, 18-bit display data input to the data input section 20 is supplied to data buses D0 to D17. For example, the display data for one pixel is made up of 18 bits consisting of R signals (RD0 to RD5), G signals (GD0 to GD5), and B signals (BD0 to BD5), six bits for each color. The setting data is supplied to the data input section 20 using the lower-order four bits of the 18 bits.

The initialization signal shown in FIG. 2 corresponds to a reset signal XRES. The clock signal shown in FIG. 2 corresponds to a dot clock signal CPH. The reset signal XRES becomes active at the L level.

The latch circuit 70 shown in FIG. 2 corresponds to flip-flops FF1-0 to FF1-17 with reset. Each of the flip-flops FF1-0 to FF1-17 holds a signal input to a data input terminal D at the rising edge of a signal input to a clock input terminal C, and outputs the held signal from a data output terminal Q. Each of the flip-flops FF1-0 to FF1-17 is initialized when a signal input to a reset terminal R is set at the L level. The data buses D0 to D17 are respectively connected with the data input terminals D of the flip-flops FF1-0 to FF1-17. The data output terminals Q of the flip-flops FF1-0 to FF1-17 are connected with input data buses D10 to D117. The reset signal XRES is input in common to the reset terminals R of the flip-flops FF1-0 to FF1-17.

The buffer 80 shown in FIG. 2 corresponds to flip-flops FF2-0 to FF2-3. Each of the flip-flops FF2-0 to FF2-3 holds a signal input to a data input terminal D at the rising edge of a signal input to a clock input terminal C, outputs the held signal from a data output terminal Q, and outputs an inversion signal of the held signal from an inversion data output terminal XQ. Each of the flip-flops FF2-0 to FF2-3 is initialized when a signal input to a reset terminal R is set at the L level. The input data buses DI0 to DI3 are respectively connected with the data input terminals D of the flip-flops FF2-0 to FF2-3. The data output terminals Q of the flip-flops FF2-0 to FF2-3 are connected with the control register 40. The reset signal XRES is input in common to the reset terminals R of the flip-flops FF2-0 to FF2-3.

The first delay circuit 90 shown in FIG. 2 corresponds to a delay circuit DLY1. The second delay circuit 90 shown in FIG. 2 corresponds to a delay circuit DLY2. In FIG. 4, delay elements are used in common for the delay circuits DLY1 and DLY2. One delay element is used in the delay circuit DLY1 and six delay elements used in the delay circuit DLY1 are connected in series in the delay circuit DLY2 so that the second delay time d2 is longer than the first delay time d1. The delay signal DC1 corresponds to a delay signal XRESd. The delay signal DC2 corresponds to a delay signal SEL. The select output signal LCLK, which is the output from the selector 94, is input in common to the clock input terminals C of the flip-flops FF1-0 to FF1-17.

In FIG. 4, a latch clock signal LCLK1 is generated based on the delay signals XRESd and SEL. The latch clock signal LCLK1 is generated so that the rising edge of the latch clock signal LCLK1 is the rising edge of the delay signal SEL. The latch clock signal LCLK1 is input in common to the clock input terminals C of the flip-flops FF2-0 to FF2-3.

In FIG. 4, a control signal SHL0 is output from the data output terminal Q of the flip-flop FF2-0. A control signal DEC0 is output from the data output terminal Q of the flip-flop FF2-1. A control signal NOUT0 is output from the data output terminal Q of the flip-flop FF2-2. A control signal RSEL0 is output from the data output terminal Q of the flip-flop FF2-3.

In FIG. 4, when the setting data fetched into the flip-flops FF2-0 to FF2-3 is first data (when the setting data is entirely "1" or "0", for example), a disable signal DISABLE for setting the fetch section 50 in a non-output state, in which at least the output of the data line driver section 32 to the data line is suspended, is generated.

When the setting data fetched into the flip-flops FF2-0 to FF2-3 is second data (when the same setting data as the first data is entirely "1" or "0", for example), the setting of the setting data in the control register 40 may be omitted by the disable signal DISABLE.

Figure 5:
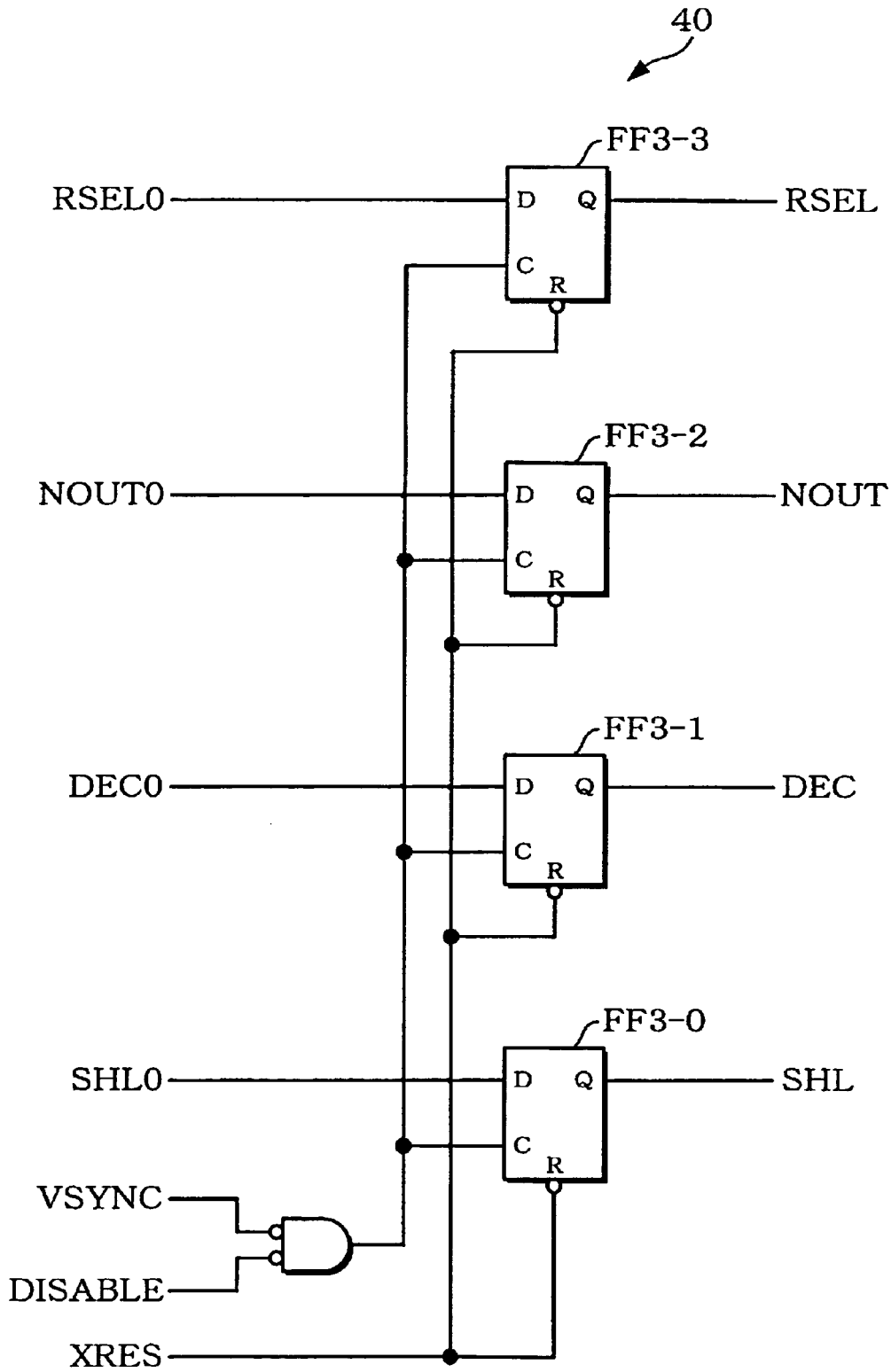
FIG. 5 is a circuit diagram showing the control register shown in FIG. 1.

FIG. 5 shows the control register 40.

The control register 40 includes flip-flops FF3-0 to FF3-3. Each of the flip-flops FF3-0 to FF3-3 is initialized when a signal input to a reset terminal R is set at the L level. The reset signal XRES is input in common to the reset terminals R of the flip-flops FF3-0 to FF3-3.

The control signal SEL0 is supplied to a data input terminal D of the flip-flop FF3-0. The shift direction setting signal SHL for setting the shift direction of the display data is output from a data output terminal Q of the flip-flop FF3-0.

The control signal DEC0 is supplied to a data input terminal D of the flip-flop FF3-1. An eight-color display mode setting signal DEC for setting the display mode in an eight-color display mode is output from a data output terminal Q of the flip-flop FF3-1.

The control signal NOUT0 is supplied to a data input terminal D of the flip-flop FF3-2. A number-of-outputs setting signal NOUT for setting the number of outputs to the data lines of the display driver 10 is output from a data output terminal Q of the flip-flop FF3-2.

The control signal RSEL0 is supplied to a data input terminal D of the flip-flop FF3-3. A resistor select signal RSEL for switching a resistor circuit of a reference voltage generation circuit which generates a plurality of reference voltages for driving the data lines is output from a data output terminal Q of the flip-flop FF3-3.

The flip-flops FF3-0 to FF3-3 fetch the control signals based on a horizontal synchronization signal HSYNC or a vertical synchronization signal VSYNC. In FIG. 5, the flip-flops FF3-0 to FF3-3 fetch the control signals in synchronization with the vertical synchronization signal VSYNC.

In FIG. 5, the setting of the setting data in the control register 40 can be omitted when the disable signal DISABLE is set at the H level. Generally, all the data buses are fixed at the L level or H level in the initial state in order to prevent occurrence of current consumption. Therefore, the setting data can be prevented from being erroneously set in the control register 40 of the display driver 10 by using the disable signal DISABLE even when the display driver 10 is connected with a display controller which cannot set the setting data at the time of initialization.

The setting data is preferably set in the control register 40 in a vertical blanking interval or a horizontal blanking interval. A display image is prevented from being affected by changing the setting in the vertical blanking interval or the horizontal blanking interval.

Figure 6:
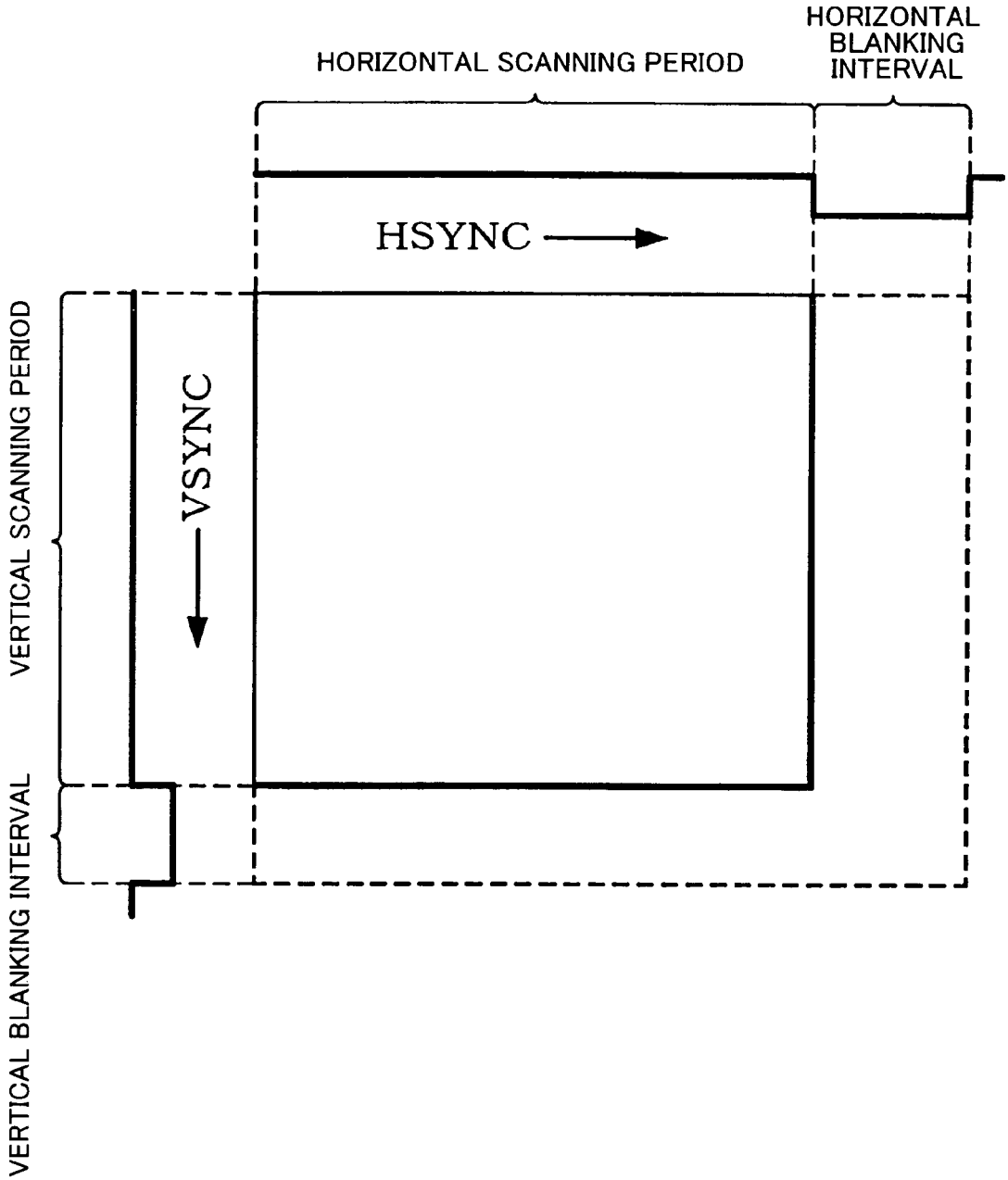
FIG. 6 illustrates a vertical blanking interval and a horizontal blanking interval.

FIG. 6 illustrates the vertical blanking interval and the horizontal blanking interval.

The horizontal scanning period is specified by the horizontal synchronization signal HSYNC. In the horizontal scanning period, a drive voltage is supplied to a pixel connected with the selected scanning line through the data line. In FIG. 6, a period in which the horizontal synchronization signal HSYNC is set at the H level is the horizontal scanning period, and a period in which the horizontal synchronization signal HSYNC is set at the L level is the horizontal blanking interval.

The vertical scanning period is specified by the vertical synchronization signal VSYNC. In the vertical scanning period, the scanning lines are sequentially selected in units of one or more scanning lines. The vertical scanning period includes a plurality of horizontal scanning periods and a plurality of horizontal blanking intervals. In FIG. 6, a period in which the vertical synchronization signal VSYNC is set at the H level is the vertical scanning period, and a period in which the vertical synchronization signal VSYNC is set at the L level is the vertical blanking interval.

Figure 7:
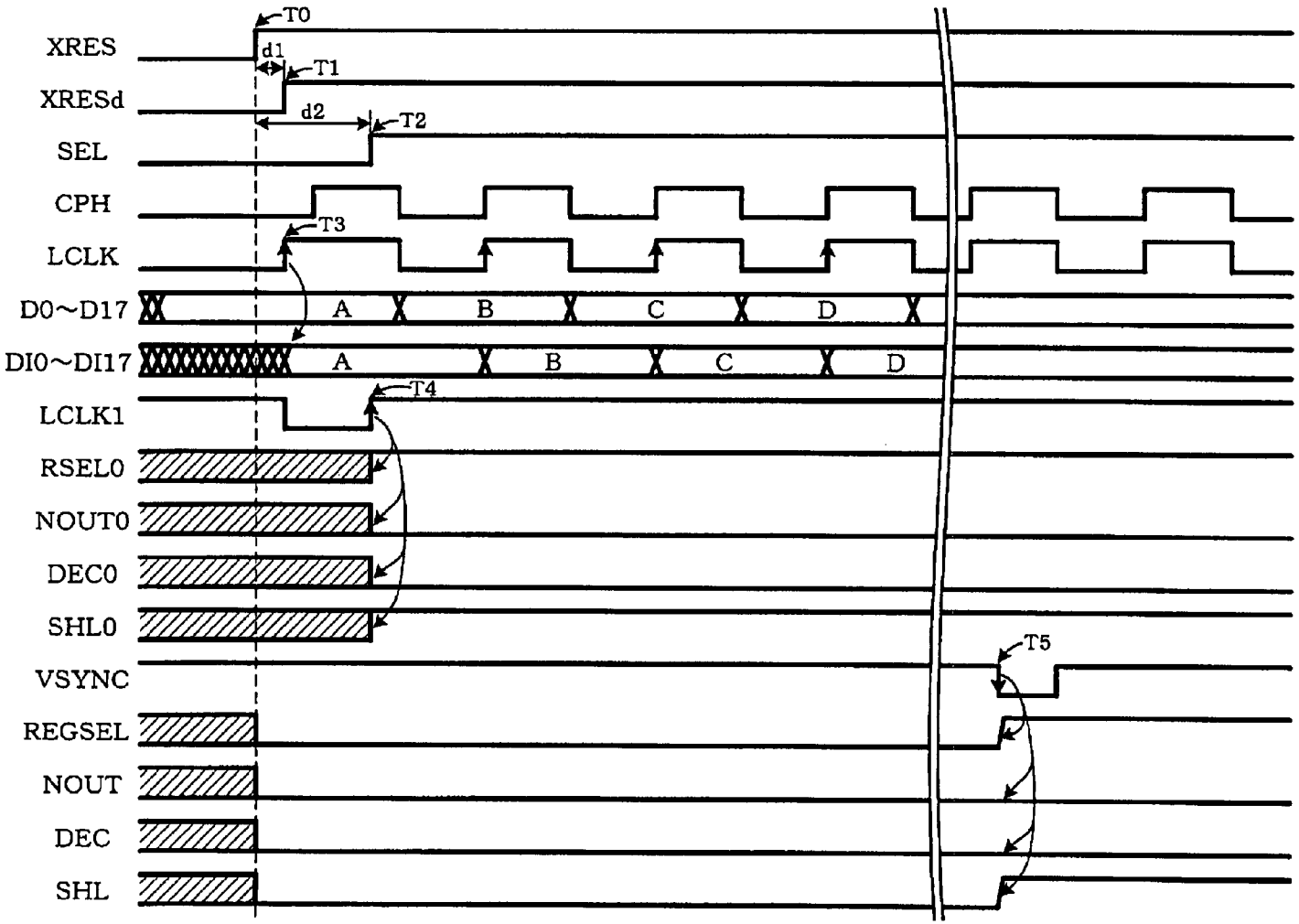
FIG. 7 is a timing chart showing an operation example of the fetch section shown in FIG. 4 and the control register shown in FIG. 5.

FIG. 7 is a timing chart showing an operation example of the fetch section 50 shown in FIG. 4 and the control register 40 shown in FIG. 5. In FIG. 7, the disable signal DISABLE remains at the L level.

The display controller (not shown) controls a scanning driver which selects the scanning line of the electro-optical panel, and a power supply circuit which provides a power supply to the display driver 10 and the scanning driver, as well as the display driver 10. The display controller controls initialization of the display driver 10, the scanning driver, and the power supply circuit at the time of initialization of the electro-optical device. The display controller initializes the display driver 10 by supplying the reset signal XRES and the setting data to the display driver 10. The display controller then supplies the dot clock signal CPH and the display data in pixel units in synchronization with the dot clock signal CPH to the display driver 10. The display controller supplies the display data corresponding to the arrangement order of the data lines of the electro-optical panel.

Each section shown in FIGS. 4 and 5 is initialized when the reset signal XRES supplied from the display controller is set at the L level. In FIGS. 4 and 5, the flip-flops FF1-0 to FF1-17, FF2-0 to FF2-3, and FF3-0 to FF3-3 are initialized. The display controller supplies the setting data to the display driver 10. In FIG. 7, setting data A is supplied to the data buses D0 to D17, for example.

The display controller changes the reset signal XRES from the L level to the H level at a time T0, and starts supplying the dot clock signal CPH. After the first delay time d1 has elapsed from the time T0, the delay signal XRESd changes from the L level to the H level in the display driver 10 (time T1). After the second delay time d2 has elapsed from the time T0, the delay signal SEL changes from the L level to the H level (time T2).

As a result, the flip-flops FF1-0 to FF1-17 fetch the data on the data buses D0 to D17 at the rising edge of the select output signal LCLK selectively output by the selector 94 (time T3). Therefore, the data on the data buses D0 to D17 is output to the input data buses DI0 to DI17. In FIG. 7, the data corresponding to the setting data A supplied to the data buses D0 to D3 (data buses D4 to D17 are at L level, for example) is fetched into the flip-flops FF1-0 to FF1-3.

At a time T4, the data on the input data buses DI0 to D13 is fetched into the flip-flops FF2-0 to FF2-3 at the rising edge of the latch clock signal LCLK1. This causes the control signals (control information) SHL0, DEC0, NOUT0, and RESL0 corresponding to the setting data fetched into the flip-flops FF2-0 to FF2-3 to change.

After the time T2 at which the delay signal SEL changes from the L level to the H level, the selector 94 outputs the dot clock signal CPH as the select output signal LCLK. Therefore, the flip-flops FF1-0 to FF1-17 fetch the data on the data buses D0 to D17 at each rising edge of the select output signal LCLK. The contents of the flip-flops FF2-0 to FF2-3 are not changed after the time T4 since the latch clock signal LCLK1 does not change.

When the vertical synchronization signal VSYNC falls at a time T5, the control signals output from the flip-flops FF2-0 to FF2-3 are fetched into the flip-flops FF3-0 to FF3-3 of the control register 40 shown in FIG. 5. As a result, the shift direction setting signal SHL, the eight-color display mode setting signal DEC, the number-of-outputs setting signal NOUT, and the resistor select signal RSEL change corresponding to the control signals output from the flip-flops FF2-0 to FF2-3.

The display processing section 30 is controlled by the shift direction setting signal SHL, the eight-color display mode setting signal DEC, the number-of-outputs setting signal NOUT, and the resistor select signal RSEL.

A configuration example of the display processing section 30 set by the control register 40 is described below.

Figure 8:
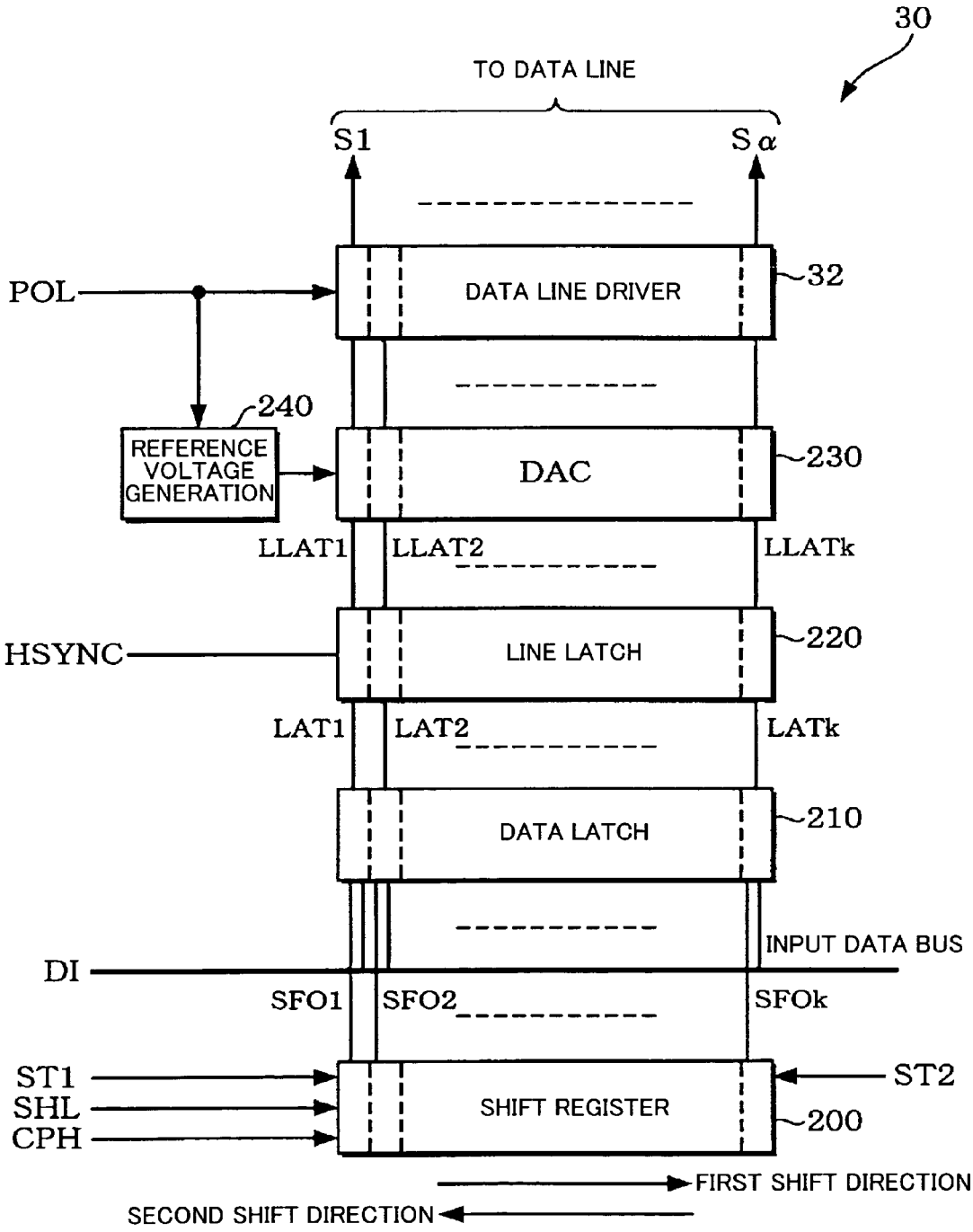
FIG. 8 is a block diagram of a configuration example of the display processing section shown in FIG. 1.

FIG. 8 is a block diagram showing the display processing section 30.

The display processing section 30 includes a shift register 200, a data latch 210, a line latch 220, a digital-to-analog converter (DAC) 230 (voltage select circuit in a broad sense), a reference voltage generation circuit 240, and the data line driver section 32.

The shift register 200 is a bidirectional shift register which performs a shift operation in synchronization with the dot clock signal CPH. The shift direction of the shift register 200 is switched by the shift direction setting signal SHL. When the shift direction setting signal SHL is set at the L level, the shift register 200 shifts a shift start signal ST1 in a first shift direction in synchronization with the dot clock signal CPH. When the shift direction setting signal SHL is set at the H level, the shift register 200 shifts a shift start signal ST2 in a second shift direction opposite to the first shift direction in synchronization with the dot clock signal CPH. The shift start signals ST1 and ST2 are signals which are set at the H level at the head position of the display data for one horizontal scan, and are supplied from the display controller, for example. The shift start signals ST1 and ST2 may be the same signal.

The shift register 200 outputs a pulse which is sequentially set at the H level by the shift operation of the shift start signals ST1 and ST2 as shift outputs SFO1 to SFOk (k is an integer of two or more). The number of shift outputs is not limited thereto.

The data latch 210 includes a plurality of flip-flops. Each flip-flop fetches the display data output to the input data bus DI as shown in FIG. 4 based on the shift output from the shift register 200. The display data fetched into the data latch 210 is output to the line latch 220.

The line latch 220 latches the display data sequentially fetched into the data latch 210 based on the horizontal synchronization signal HSYNC, and outputs the display data for one horizontal scan to the DAC 230.

The DAC 230 selects a reference voltage corresponding to the display data for one output (6-bit R signal, G signal, or B signal) from the reference voltages generated by the reference voltage generation circuit 240.

The reference voltage generation circuit 240 generates reference voltages V0 to V63, each of which corresponds to the grayscale of the display data represented by six bits. The reference voltage generation circuit 240 outputs a plurality of divided voltages generated by dividing the voltage between a high-potential-side power supply voltage (first power supply voltage) VDD and a low-potential-side power supply voltage (second power supply voltage) VSS by using a resistor circuit as the reference voltages V0 to V63. The data line driver circuit 32 includes a plurality of data output sections, each of which corresponds to one data line. The data output section drives the data line using the reference voltage output from the DAC 230.

The display processing section 30 performs polarity reversal drive in synchronization with a polarity reversal signal POL in a given polarity reversal cycle. The polarity reversal signal POL is supplied from the display controller. In the polarity reversal drive, the polarity of voltage applied to an electro-optical substance (liquid crystal, for example) is reversed with respect to a given reference potential.

Figure 9:
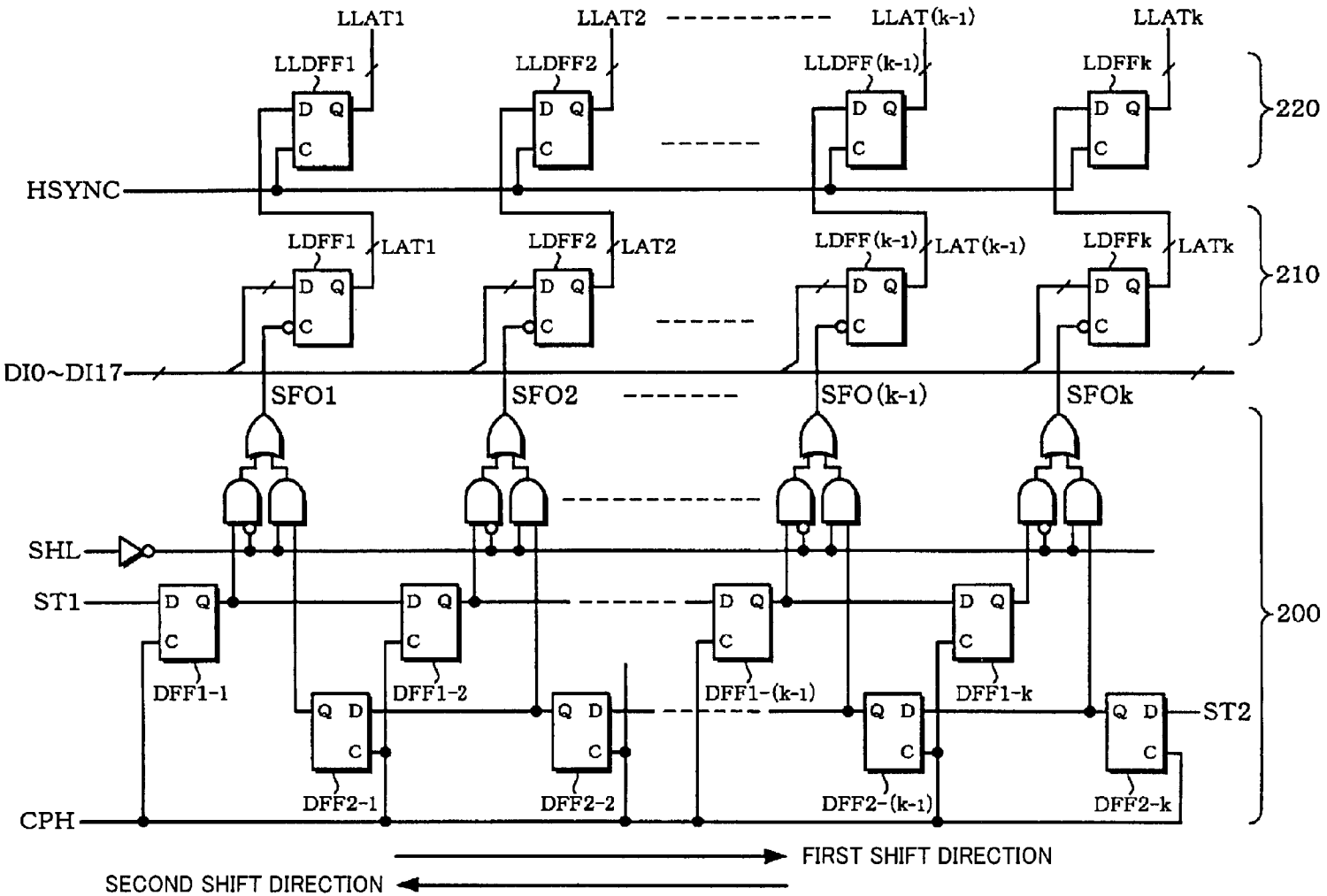
FIG. 9 is a circuit diagram showing the shift register, the data latch, and the line latch shown in FIG. 8.

FIG. 9 shows the shift register 200, the data latch 210, and the line latch 220.

The shift register 200 includes first to kth D flip-flops DFF1-1 to DFF1-k for realizing the shift operation in the first shift direction. In the following description, the ith D flip-flop ($1 \leqq i \leqq k$, i is an integer) is denoted as the D flip-flop DFF1-i. Each D flip-flop includes a data input terminal D, a clock input terminal C, and a data output terminal Q. Each D flip-flop holds the logical level of a signal input to the data input terminal D at the rising edge of a signal input to the clock input terminal C, and outputs data at the held logical level from the data output terminal Q. The D flip-flops DFF1-1 to DFF1-k are connected in series. Specifically, the data output terminal Q of the D flip-flop DFF1-j ($1 \leqq j \leqq k-1$, j is an integer) is connected with the data input terminal D of the D flip-flop DFF1-(j+1) in the subsequent stage.

The shift start signal ST1 is input to the data input terminal D of the D flip-flop DFF1-1. The dot clock signal CPH is input in common to the clock input terminals C of the D flip-flops DFF1-1 to DFF1-k.

The shift register 200 includes first to kth D flip-flops DFF2-1 to DFF2-k for realizing the shift operation in the second shift direction. The D flip-flops DFF2-1 to DFF2-k are connected in series. Specifically, the data output terminal Q of the D flip-flop DFF2-j ($1 \leqq j \leqq k-1$, j is an integer) is connected with the data input terminal D of the D flip-flop DFF2-(j+1) in the subsequent stage.

The shift start signal ST2 is input to the data input terminal D of the D flip-flop DFF2-1. The dot clock signal CPH is input in common to the clock input terminals C of the D flip-flops DFF2-1 to DFF2-k.

The signal from the data output terminal Q of the D flip-flop DFF1-i or the signal from the data output terminal Q of the D flip-flop DFF2-i is output as the shift output SFOi based on an inversion signal of the shift direction setting signal SHL.

The data latch 210 includes first to kth latch D flip-flops. In the following description, the ith latch D flip-flop ($1 \leqq i \leqq k$, i is an integer) is denoted as the D flip-flop LDFFi. Each latch D flip-flop includes a data input terminal D, a clock input terminal C, and a data output terminal Q. Each latch D flip-flop holds the logical level of a signal input to the data input terminal D at the falling edge of a signal input to the clock input terminal C, and outputs data at the held logical level from the data output terminal Q. The latch D flip-flop holds 18-bit display data. The shift output SFOi from the shift register 200 is supplied to the clock input terminal C of the D flip-flop LDFFi. Latch data LATi is data from the data output terminal Q of the D flip-flop LDFFi. The data bus is connected in common with the data input terminals D of the D flip-flops LDFF1 to LDFFk.

The line latch 220 includes first to kth line latch D flip-flops. In the following description, the ith line latch D flip-flop ($1 \leqq i \leqq k$, i is an integer) is denoted as the D flip-flop LLDFFi. Each line latch D flip-flop includes a data input terminal D, a clock input terminal C, and a data output terminal Q. The D flip-flop holds the logical level of a signal input to the data input terminal D at the rising edge of a signal input to the clock input terminal C, and outputs data at the held logical level from the data output terminal Q. The line latch D flip-flop holds 18-bit display data. The horizontal synchronization signal HSYNC is supplied to the clock input terminal C of the D flip-flop LLDFFi. Line latch data LLATi is data from the data output terminal Q of the D flip-flop LLDFFi. The data output terminal Q of the D flip-flop LDFFi is connected with the data input terminal D of the D flip-flop LLDFFi.

It is preferable that the D flip-flops DFF1-1 to DFF1-k, DFF2-1 to DFF2-k, LDFF1 to LDFFk, and LLDFF1 to LLDFFk be initialized by the reset signal XRES.

The shift register 200 having such a configuration is shift-controlled based on the shift direction setting signal SHL from the control register 40.

Figure 10:
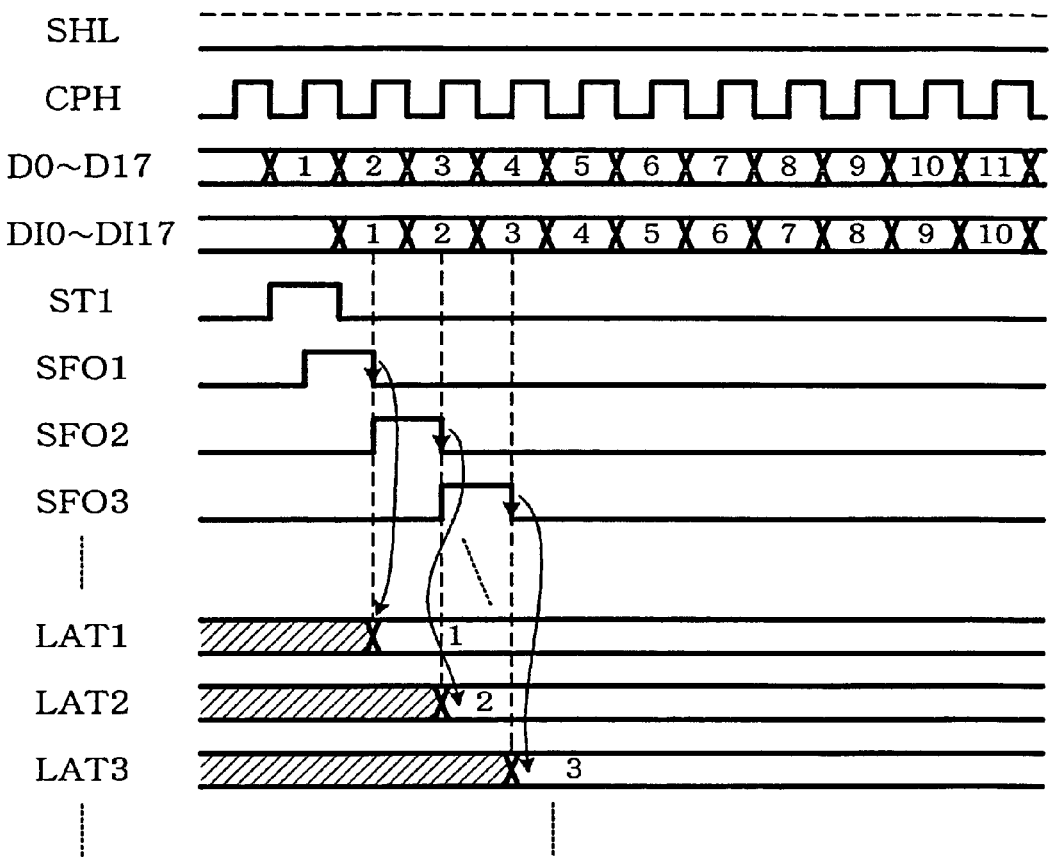
FIG. 10 is a timing chart showing an operation example of the shift register and the data latch shown in FIG. 8 when a shift direction setting signal is set at the L level.

FIG. 10 is a timing chart showing an operation example of the shift register 200 and the data latch 210 when the shift direction setting signal SHL is set at the L level.

The display data is sequentially supplied to the data bus in pixel units in synchronization with the dot clock signal CPH. The shift start signal ST1 is set at the H level corresponding to the head position of the display data.

When the shift direction setting signal SHL is set at the L level, the shift register 200 performs the shift operation in the first shift direction. Specifically, the shift register 200 fetches the shift start signal ST1 at the rising edge of the dot clock signal CPH. The shift register 200 sequentially outputs a pulse shifted in synchronization with the rising edge of the dot clock signal as the shift outputs SFO1 to SFOk in each stage.

The data latch 210 fetches the display data on the data bus at the falling edge of the shift output in each stage of the shift register 200. As a result, the data latch 210 fetches the display data in the order of the D flip-flops LDFF1, LDFF2 . . . . The display data fetched into the D flip-flops LDFF1 to LDFFk is respectively output as the latch data LAT1 to LATk.

The line latch 220 latches the display data fetched into the data latch 210 in units of one horizontal scanning period.

Figure 11:
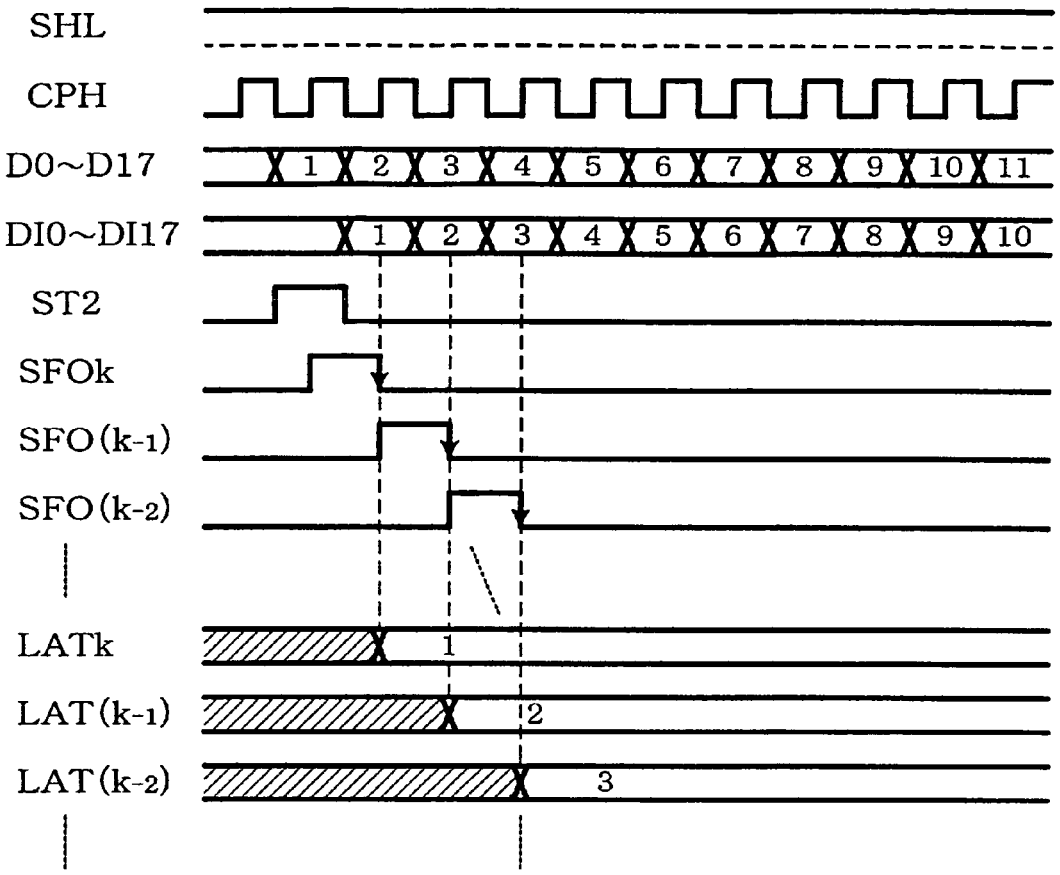
FIG. 11 is a timing chart showing an operation example of the shift register and the data latch shown in FIG. 8 when a shift direction setting signal is set at the H level.

FIG. 11 is a timing chart showing an operation example of the shift register 200 and the data latch 210 when the shift direction setting signal SHL is set at the H level.

The display data is sequentially supplied to the data bus in pixel units in synchronization with the dot clock signal CPH. The shift start signal ST2 is set at the H level corresponding to the head position of the display data.

When the shift direction setting signal SHL is set at the H level, the shift register 200 performs the shift operation in the second shift direction. Specifically, the shift register 200 fetches the shift start signal ST2 at the rising edge of the dot clock signal CPH. The shift register 200 sequentially outputs a pulse shifted in synchronization with the rising edge of the dot clock signal as the shift outputs SFOk to SFO1 in each stage.

The data latch 210 fetches the display data on the data bus at the falling edge of the shift output in each stage of the shift register 200. As a result, the display data is fetched into the data latch 210 in the order of the D flip-flops LDFFk, LDFF (k-1), . . . . The display data fetched into the D flip-flops LDFF1 to LDFFk is respectively output as the latch data LAT1 to LATk.

The line latch 220 latches the display data fetched into the data latch 210 in units of one horizontal scanning period.

As described above, the display controller which supplies the display data to the display driver 10 can serially supply the display data always in the same order irrespective of the arrangement direction of the data lines by controlling the shift direction of the shift register 200 by using the shift direction setting signal SHL.

The display data for one horizontal scan latched by the line latch 220 is supplied to the DAC 230.

The reference voltage generation circuit 240 which supplies the reference voltages to the DAC 230 is described below.

Figure 12:
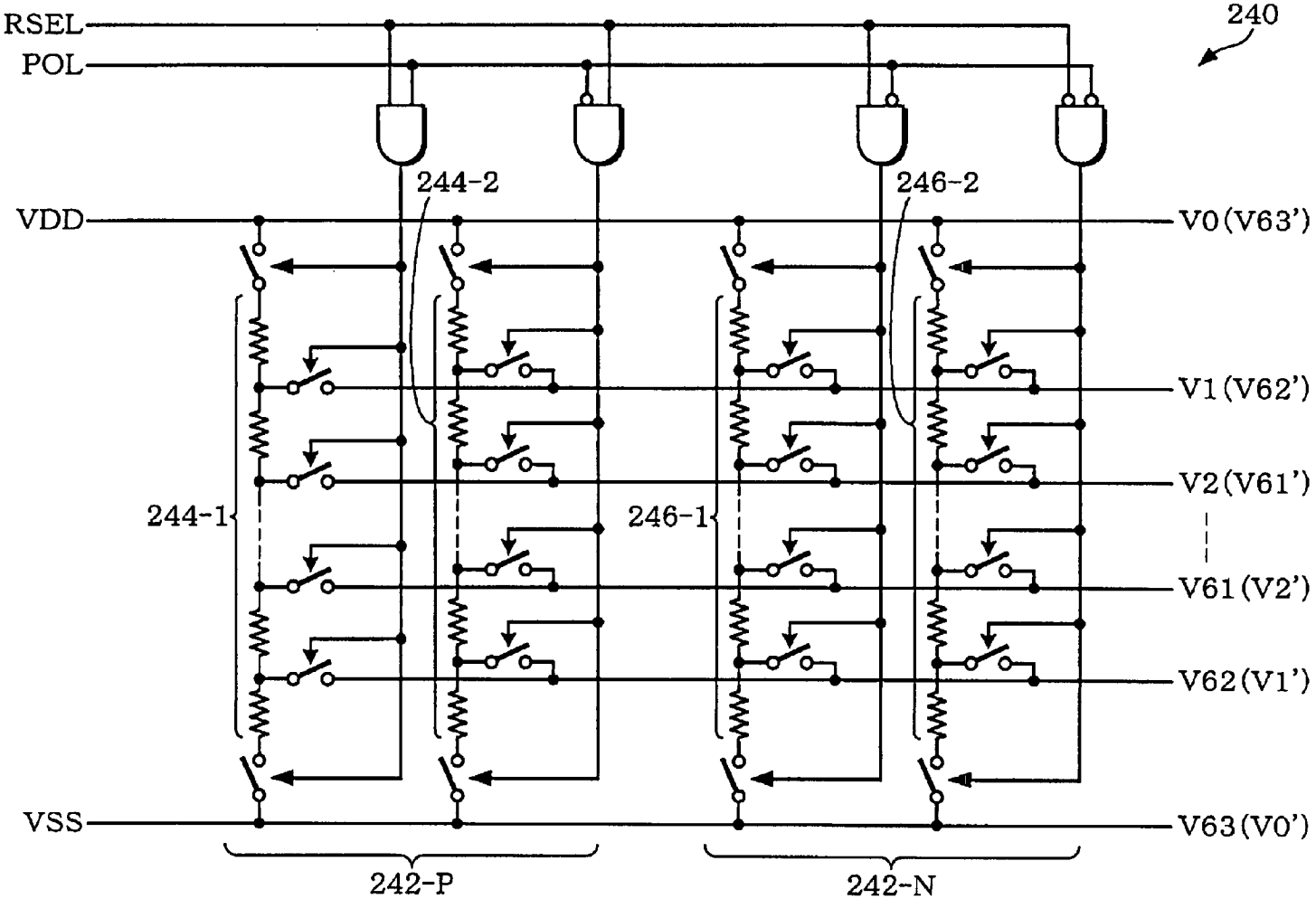
FIG. 12 is a circuit diagram showing the reference voltage generation circuit shown in FIG. 8.

FIG. 12 shows the reference voltage generation circuit 240.

The reference voltage generation circuit 240 generates the reference voltages by dividing the voltage between the high-potential-side power supply voltage VDD and the low-potential-side power supply voltage VSS by using a resistor circuit.

The reference voltage generation circuit 240 includes a positive ladder resistor circuit 242-P and a negative ladder resistor circuit 242-N. The positive ladder resistor circuit 242-P generates reference voltages V1 to V62 used in a polarity reversal cycle when the polarity reversal signal POL is set at a first logical level. The negative ladder resistor circuit 242-N generates the reference voltages V1 to V62 used in a polarity reversal cycle when the polarity reversal signal POL is set at a second logical level. It is unnecessary to switch the high-potential-side and low-potential-side power supply voltages VDD and VSS accompanying the polarization reversal by providing the ladder resistor circuits for each polarity and selectively outputting the reference voltage at each polarity according to a given polarity reversal timing. This reduces charging and discharging due to switching of the power supply voltage.

The positive ladder resistor circuit 242-P includes ladder resistor circuits 244-1 and 244-2. If the ratio of the total resistance of the ladder resistor circuit to the resistance of each resistor element which makes up the ladder resistor circuit is referred to as a "resistance ratio", the resistance ratio of the ladder resistor circuit 244-1 differs from the resistance ratio of the ladder resistor circuit 244-2.

The negative ladder resistor circuit 242-N includes ladder resistor circuits 246-1 and 246-2. The resistance ratio of the ladder resistor circuit 246-1 differs from the resistance ratio of the ladder resistor circuit 246-2.

This enables the reference voltages V1 to V62 generated by the ladder resistor circuit 244-1 to differ from the reference voltages V1 to V62 generated by the ladder resistor circuit 244-2 as the positive reference voltages. This also enables the reference voltages V1 to V62 generated by the ladder resistor circuit 246-1 to differ from the reference voltages V1 to V62 generated by the ladder resistor circuit 246-2 as the negative reference voltages.

The grayscale characteristics differ depending on the characteristics of the electro-optical device driven by the display driver 10 (characteristics of electro-optical material) and manufacturing variation. Therefore, it is necessary to generate an optimum reference voltage corresponding to the characteristics of the electro-optical device and the like even if the display data is the same. In the reference voltage generation circuit 240, a ladder resistor circuit with an optimum resistance ratio can be selected from the two ladder resistor circuits for each polarity by a resistor select signal RSEL.

One of the ladder resistor circuits 244-1 and 244-2 and one of the ladder resistor circuits 246-1 and 246-2 are respectively selected for positive and negative ladder resistor circuits corresponding to the decode result for the polarity reversal signal POL and the resistor select signal RSEL. A desired ladder resistor circuit can be selected by turning ON or OFF switch circuits between each ladder resistor circuit and the high-potential-side and low-potential-side power supply voltages.

As described above, the reference voltage generation circuit 240 can generate a plurality of patterns of the reference voltages V0 to V63 by switching the ladder resistor circuit by using the resistor select signal RSEL.

Figure 13:
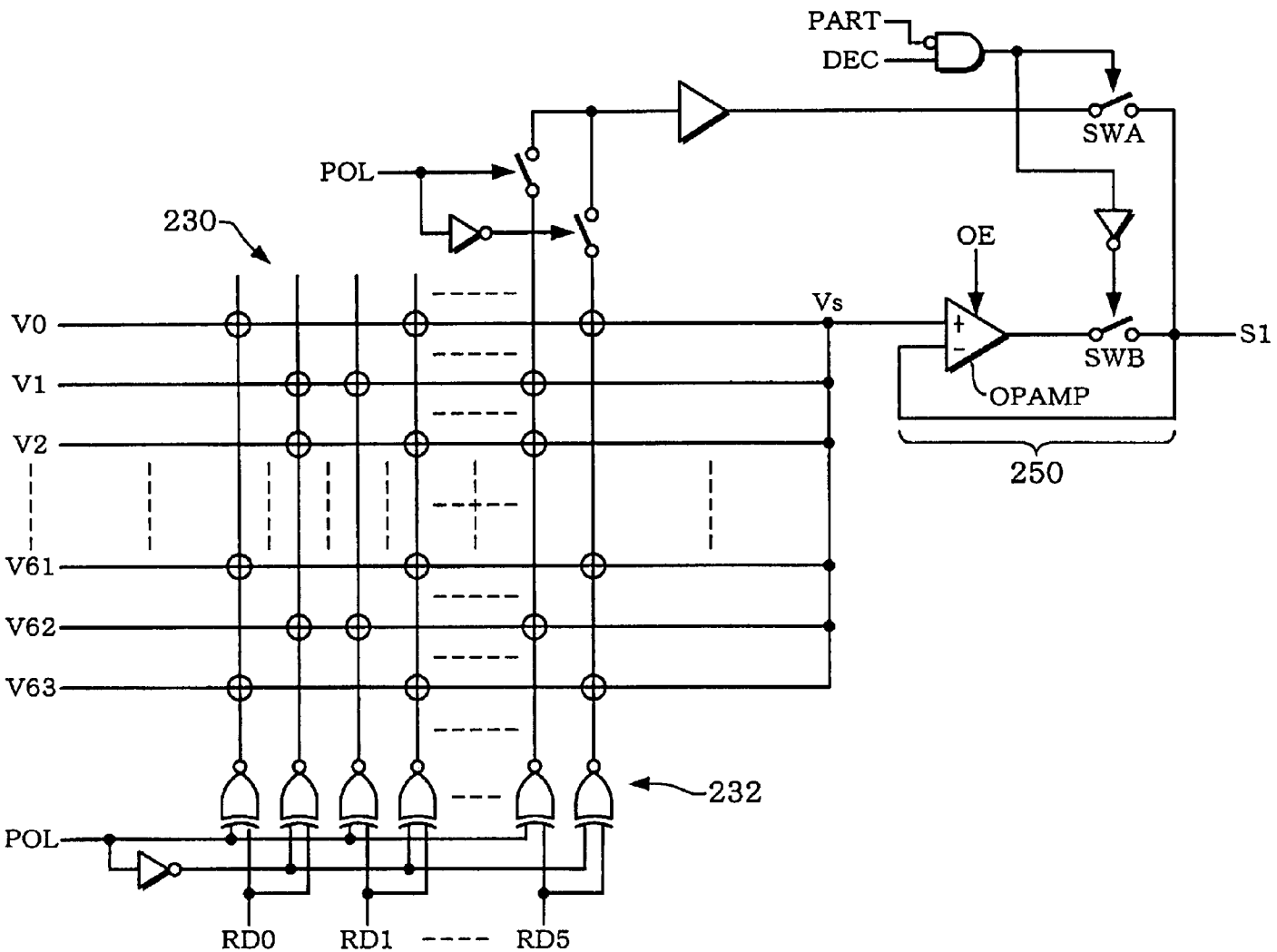
FIG. 13 is a circuit diagram showing the DAC and one data output section of the data line driver section shown in FIG. 8.

FIG. 13 shows the DAC 230 and one data output section of the data line driver section 32. Specifically, FIG. 13 shows only a configuration for one output of the data line driver section 32.

The DAC 230 may be realized by a read only memory (ROM) decoder circuit. The DAC 230 selects one of the reference voltages V0 to V63 based on the 6-bit display data (display data for one dot), and outputs the selected reference voltage to the data output section 250 as a select voltage Vs.

In more detail, the DAC 230 includes an inversion circuit 232 which reverses 6-bit display data RD0 to RD5 based on the polarity reversal signal POL. The inversion circuit 232 performs non-inversion output of each bit of the display data when the polarity reversal signal POL is set at the H level. The inversion circuit 232 performs inversion output of each bit of the display data when the polarity reversal signal POL is set at the L level. The output from the inversion circuit 232 is input to the ROM decoder. In this example, the display data RD5 is the most significant bit.

In the DAC 230, one of the reference voltages V0 to V63 generated by the reference voltage generation circuit 240 is selected based on the output from the inversion circuit 232.

When the polarity reversal signal POL is set at the first logical level, the reference voltage V2 generated by the positive ladder resistor circuit 242-P is selected corresponding to the 6-bit display data D0 to D5 "000010" (=2), for example. When the polarity reversal signal POL is set at the second logical level at the next polarity reversal timing, the reference voltage is selected using the data obtained by bit-reversing the display data RD5 to RD0. Specifically, the reference voltage V61' generated by the negative ladder resistor circuit 242-N is selected by the bit-reversed data "111101" (=61). As shown in FIG. 12, the reference voltages V2 and V61' are output from the same output node of the reference voltage generation circuit 240. As described above, since the voltage from the same output node is used as positive and negative voltages, it is unnecessary to frequently repeat charging and discharging of the output node of the reference voltage generation circuit.

The select voltage Vs selected by the DAC 230 is input to the data output section 250.

The data output section 250 includes an operational amplifier circuit OPAMP and switch circuits SWA and SWB. The operational amplifier circuit OPAMP is a voltage-follower-connected operational amplifier. The operational amplifier circuit OPAMP is output-controlled by an output enable signal OE. The output enable signal OE is generated in units of data output sections corresponding to the number-of-outputs setting signal NOUT.

FIG. 14 shows an example of the number of outputs set by the number-of-outputs setting signal NOUT. When the number-of-outputs setting signal NOUT is set at the H level, the number of outputs is set at α (α is an integer). This causes enable control of the data output sections corresponding to the data lines S1 to Sα by the output enable signals OE to be set to an ON state, whereby output control by the output enable signal OE is performed in the display period. As an example of the output control in the display period, current control of the operational amplifier circuit OPAMP can be given.

When the number-of-outputs setting signal NOUT is set at the L level, the number of outputs is set at β ($1<\beta<\alpha$, β is an integer). This causes enable control of the data output sections corresponding to the data lines S1 to Sβ by the output enable signals OE to be set to an ON state. The enable control of the data output sections corresponding to the data lines S(β+1) to Sα by the output enable signals OE to is set to an OFF state. In this case, the drive output of the operational amplifier circuits OPAMP of the data output sections corresponding to the data lines S(β+1) to Sα is suspended.

In FIG. 13, when the enable control by the output enable signal OE is set to an ON state and output ON is indicated by the output enable signal OE, the operational amplifier circuit OPAMP drives the output node connected with the data line S1 based on the select voltage Vs.

In FIG. 13, the drive output to the data line may be suspended by turning OFF the drive output of the operational amplifier circuit OPAMP and turning OFF the switch circuits SWA and SWB when the disable signal DIABLE signal is set at the H level.

In the display driver 10, ON or OFF of the drive output can be designated in units of one or more data output sections. The data line is driven by the operational amplifier circuit OPAMP when the drive output is set to ON. The data line is not driven by the operational amplifier circuit OPAMP when the drive output is set to OFF. ON or OFF of the drive output by the data output section 250 is designated by a partial setting signal PART. The partial setting signal PART is designated by the display controller.

When the drive output of the data output section 250 shown in FIG. 13 is set to OFF by the partial setting signal PART, the switch circuit SWB is turned OFF and the switch circuit SWA is turned ON. A signal voltage corresponding to the data of the most significant bit RD5 of the display data selected corresponding to the polarity specified by the polarity reversal signal POL is supplied to the data line S1 through the switch circuit SWA.

In this case, since the partial setting signal PART is designated in pixel units, eight-color display can be performed by using 1-bit data for each color. This enables a desired video image or still image to be displayed in a partial display area in which the drive output is set to ON by the partial setting signal PART, and an image display with variety of display colors to be performed in a partial non-display area in which the drive output is set to OFF by the partial setting signal PART.

An electro-optical device including a data driver to which is applied the display driver according to one embodiment of the present invention is described below.

Figure 15:
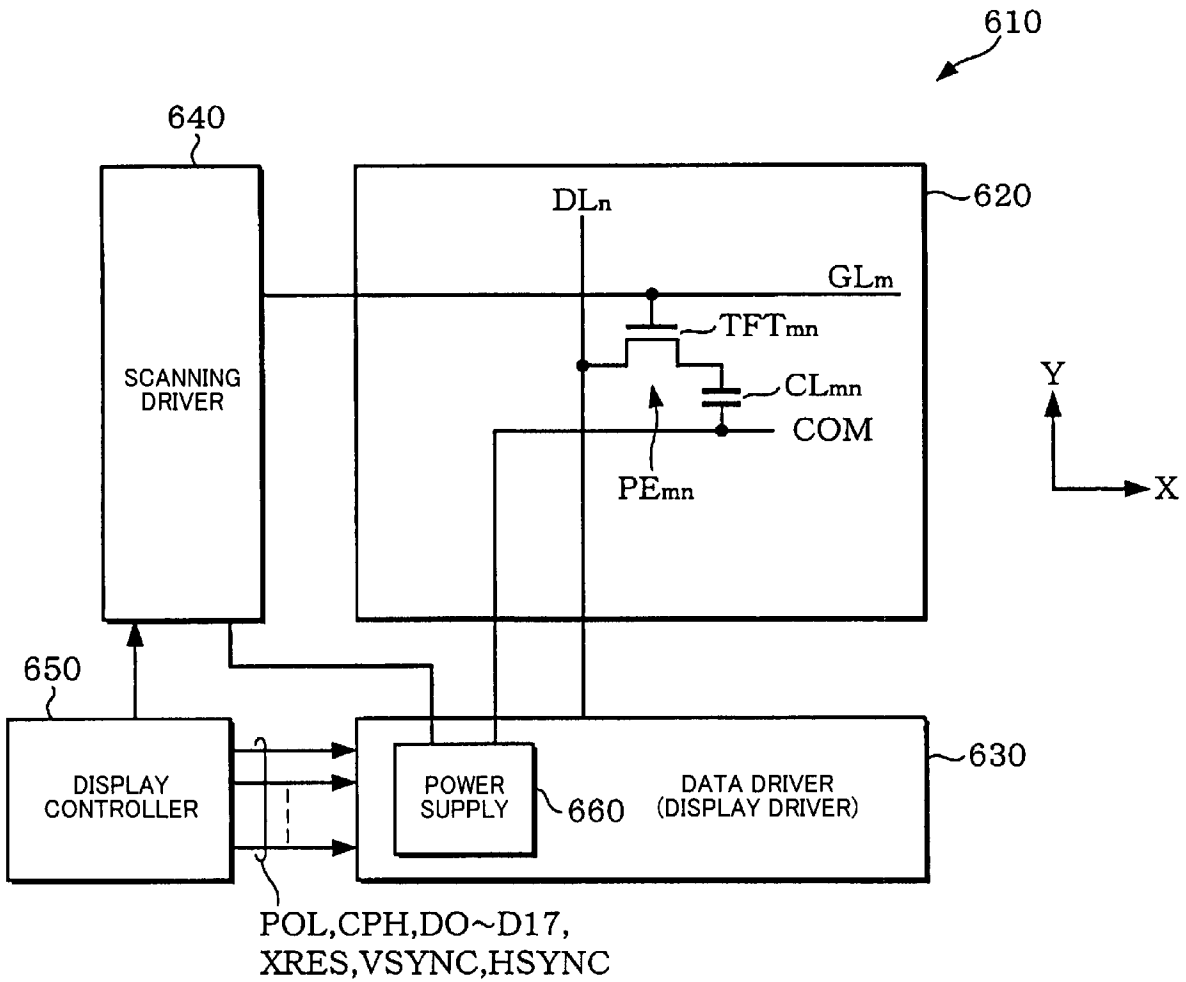
FIG. 15 is a diagram showing an electro-optical device according to one embodiment of the present invention.

FIG. 15 shows an electro-optical device according to one embodiment of the present invention. The following description is given taking a liquid crystal device as an example of an electro-optical device.

An electro-optical device may be incorporated into various electronic instruments such as a portable telephone, portable information instrument (PDA or the like), digital camera, projector, portable audio player, mass storage device, video camera, electronic notebook, or global positioning system (GPS).

In FIG. 15, an electro-optical device 610 includes a liquid crystal display (LCD) panel 620 (display panel or electro-optical panel in a broad sense), a data driver 630, a scanning driver 640 (gate driver), and an LCD controller 650 (display controller in a broad sense). The data driver 630 includes the function of the display driver 10.

The electro-optical device 610 does not necessarily include all of these circuit blocks. The electro-optical device 610 may have a configuration in which some of the circuit blocks are omitted.

The LCD panel 620 includes a plurality of scanning lines (gate lines), each of the scanning lines being provided in one of rows, a plurality of data lines (source lines) which intersect the scanning lines, each of the data lines being provided in one of columns, and a plurality of pixels, each of the pixels being specified by one of the scanning lines and one of the data lines. Each pixel includes a thin-film transistor (hereinafter abbreviated as "TFT") and a pixel electrode. The TFT is connected with the data line, and the pixel electrode is connected with the TFT.

In more detail, the LCD panel 620 is formed on a panel substrate such as a glass substrate. A plurality of scanning lines GL1 to GLM (M is an integer of two or more; M is preferably three or more), arranged in the Y direction shown in FIG. 15 and extending in the X direction, and a plurality of data lines DL1 to DLN (N is an integer of two or more), arranged in the X direction and extending in the Y direction, are disposed on the panel substrate. A pixel PEmn is provided at a position corresponding to the intersecting point of the scanning line GLm ($1 \leqq m \leqq M$, m is an integer) and the data line DLn ($1 \leqq n \leqq N$, n is an integer). The pixel PEmn includes the thin-film transistor TFTmn and the pixel electrode.

A gate electrode of the thin-film transistor TFTmn is connected with the scanning line GLm. A source electrode of the thin-film transistor TFTmn is connected with the data line DLn. A drain electrode of the thin-film transistor TFTmn is connected with the pixel electrode. A liquid crystal capacitor CLmn is formed between the pixel electrode and a common electrode COM which faces the pixel electrode through a liquid crystal element (electro-optical material in a broad sense). A storage capacitor may be formed in parallel with the liquid crystal capacitor CLmn. The transmissivity of the pixel changes corresponding to the voltage applied between the pixel electrode and the common electrode COM. A voltage VCOM supplied to the common electrode COM is generated by the power supply circuit 660 included in the data driver 630.

The LCD panel 620 is formed by attaching a first substrate on which the pixel electrode and the TFT are formed to a second substrate on which the common electrode is formed, and sealing a liquid crystal as an electro-optical material between the two substrates, for example.

The data driver 630 drives the data lines DL1 to DLN of the LCD panel 620 based on display data for one horizontal scan supplied in units of one horizontal scanning period. In more detail, the data driver 630 drives at least one of the data lines DL1 to DLN based on the display data.

The scanning driver 640 scans the scanning lines GL1 to GLM of the LCD panel 620. In more detail, the scanning driver 640 sequentially selects the scanning lines GL1 to GLM in one vertical scanning period, and drives the selected scanning line.

The LCD controller 650 outputs control signals to the scanning driver 640 and the data driver 630 (power supply circuit 660) according to the content set by a host such as a CPU (not shown). In more detail, after the LCD controller 650 is initialized, the LCD controller 650 initializes the data driver 630 and the scanning driver 640. The LCD controller 650 outputs the reset signal XRES to the data driver 630, and supplies the setting data to the data driver 630. The LCD controller 650 then supplies an operation mode setting, the horizontal synchronization signal HSYNC and the vertical synchronization signal VSYNC generated therein, the dot clock signal CPH, and the display data, for example. The LCD controller 650 controls the power supply circuit 660 relating to polarity reversal timing of the voltage VCOM applied to the common electrode COM by using the polarity reversal signal POL.

The power supply circuit 660 generates various voltages supplied to the scanning driver 640 and the voltage VCOM applied to the common electrode COM based on the reference voltage supplied from the outside. In the data driver 630, the power supply circuit 660 may not output voltage when the disable signal DISABLE is set at the H level.

In FIG. 15, the electro-optical device 610 is configured to include the LCD controller 650. However, the LCD controller 650 may be provided outside the electro-optical device 610. The host (not shown) may be included in the electro-optical device 610 together with the LCD controller 650.

At least one of the scanning driver 640 and the LCD controller 650 may be included in the data driver 630.

Figure 16:
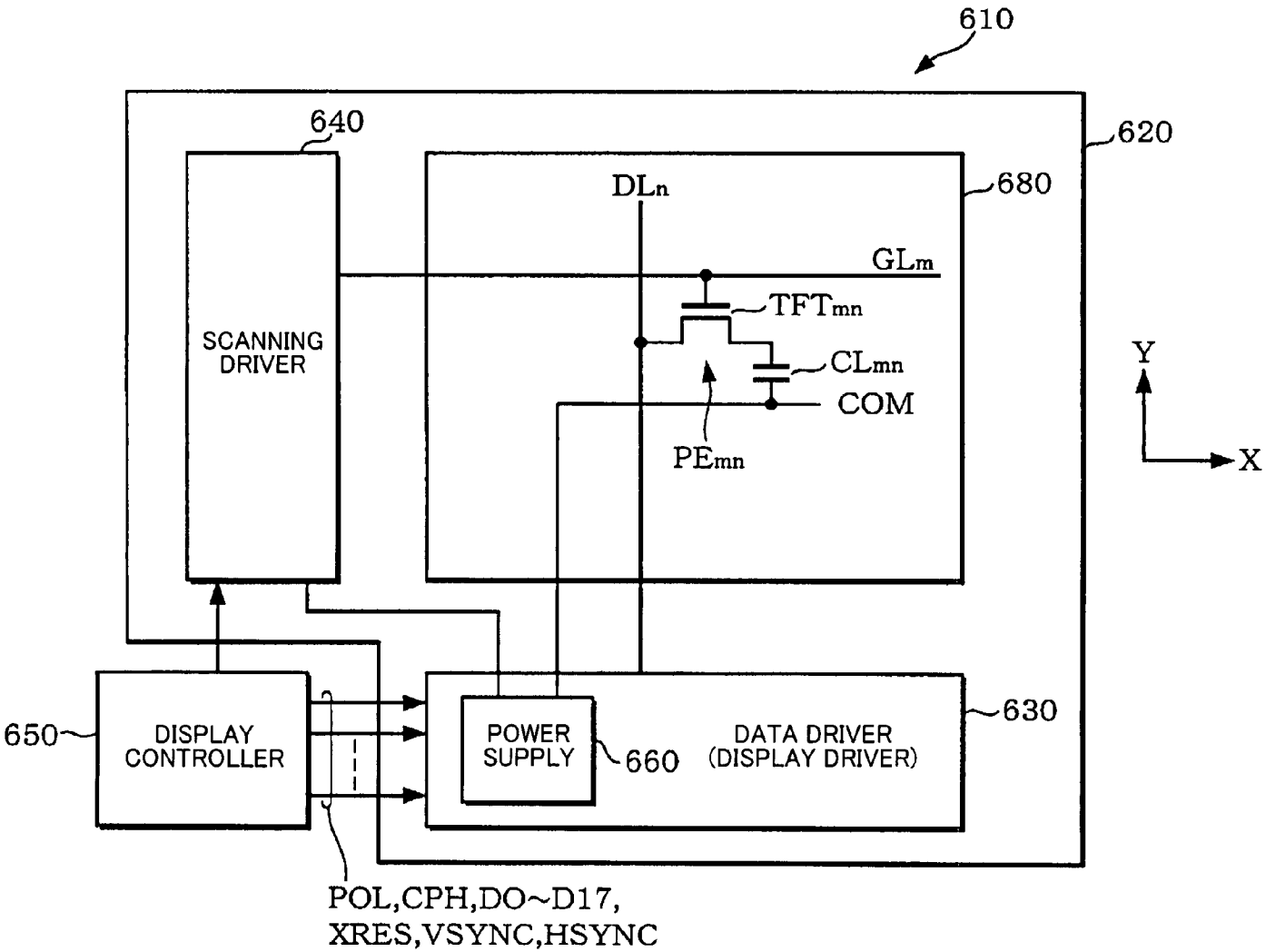
FIG. 16 is a diagram showing an electro-optical device according to another embodiment of the present invention.

Some or the entirety of the data driver 630, the scanning driver 640, and the LCD controller 650 may be formed on the LCD panel 620. In FIG. 16, the data driver 630 and the scanning driver 640 are formed on the LCD panel 620. The LCD panel 620 may be configured to include a plurality of data lines, a plurality of scanning lines, a plurality of pixels, each of the pixels being specified by one of the data lines and one of the scanning lines, and a data driver which drives the data lines. The pixels are formed in a pixel formation region 680 of the LCD panel 620.

The present invention is not limited to the above-described embodiment. Various modifications and variations are possible within the spirit and scope of the present invention. For example, the present invention can be applied not only to drive the liquid crystal display panel, but also to drive an electroluminescent or plasma display device.

The above embodiments are described on the assumption that each of the control signals SHL0, DEC0, NOUT0, and RSEL0 is one bit. However, each of the control signals may be two or more bits. The number of bits of setting data is not limited.

The above embodiments illustrate the case where the shift direction, the number of outputs, the eight-color display mode, and the resistor selection are set by using the setting data at the time of initialization. However, the present invention is not limited thereto. A setting of which the set state is not changed during the normal operation (display operation), such as a voltage setting of the power supply circuit included in the data driver or a setting of terminal assignment, may be set by the setting data at the time of initialization.

Part of requirements of any claim of the present invention could be omitted from a dependent claim which depends on that claim. Moreover, part of requirements of any independent claim of the present invention could be made to depend on any other independent claim.

What is claimed is:

1. A display driver that drives a plurality of data lines of an electro-optical panel, the electro-optical panel having a plurality of scanning lines and a plurality of pixels in addition to the data lines, the display driver comprising:

a data input section, display data or setting data being input to the data input section;

a latch circuit that fetches the display data or the setting data, each of the display data and the setting data having been input through the data input section;

a display processing section having a data line driver section, the data line driver section driving the data lines by using the display data fetched in the latch circuit;

a control register that is used for controlling the display processing section;

buffer that fetches only the setting data fetched in the latch circuit based on an initial setting signal;

a first delay circuit that delays an initialization signal for a first delay time;

a second delay circuit that delays the initialization signal for a second delay time, the second delay time being longer than the first delay time; and a selector that selectively outputs an output from the first delay circuit or a clock signal, based on an output from the second delay circuit, the setting data fetched into the buffer being set in the control register after at least one of the display processing section and the control register has been initialized by the initialization signal, the display processing section being controlled based on the setting data set in the control register, the initial setting signal being the initialization signal, the latch circuit fetching the display data or the setting data input through the data input section based on an output from the selector, the display data being input to the data input section in synchronization with the clock signal, the data line driver section driving the data lines by using the display data fetched into the latch circuit based on the clock signal selectively output from the selector, the buffer holding the setting data based on the outputs from the first and second delay circuits, the setting data having been fetched into the latch circuit based on the output of the first delay circuit selectively output by the selector, and the setting data held by the buffer being set in the control register based on a horizontal synchronization signal specifying a horizontal scanning period or based on a vertical synchronization signal specifying a vertical scanning period.

2. The display driver as defined in claim 1, the setting data being set in the control register during a horizontal blanking interval specified by the horizontal synchronization signal or during a vertical blanking interval specified by the vertical synchronization signal.

3. The display driver as defined in claim 2, when the setting data fetched into the buffer is first data, at least an output of the data line driver section to the data lines being suspended.

4. The display driver as defined in claim 1, when the setting data fetched into the buffer is first data, at least an output of the data line driver section to the data lines being suspended.

5. The display driver as defined in claim 4, when the setting data fetched into the buffer is second data, setting of the setting data in the control register being omitted.

6. The display driver as defined in claim 4, further comprising:

an initial setting signal input section, the initial setting signal is input to the initial setting signal input section.

7. An electro-optical device comprising:

a plurality of scanning lines;

a plurality of data lines;

a plurality of pixels; and the display driver as defined in claim 4 that drives the data lines.

8. The display driver as defined in claim 1, when the setting data fetched into the buffer is second data, setting of the setting data in the control register being omitted.

9. The display driver as defined in claim 8, further comprising:

an initial setting signal input section, the initial setting signal is input to the initial setting signal input section.

10. An electro-optical device comprising:

a plurality of scanning lines;

a plurality of data lines;

a plurality of pixels; and the display driver as defined in claim 8 that drives the data lines.

11. The display driver as defined in claim 1, further comprising:

an initial setting signal input section, the initial setting signal is input to the initial setting signal input section.

12. An electro-optical device comprising:

a plurality of scanning lines;

a plurality of data lines;

a plurality of pixels; and the display driver as defined in claim 11 that drives the data lines.

13. An electro-optical device comprising:

a plurality of scanning lines;

a plurality of data lines;

a plurality of pixels; and the display driver as defined in claim 1 that drives the data lines.

* * * * *